US011111552B2

(12) United States Patent
Forbes Jones et al.

(10) Patent No.: US 11,111,552 B2
(45) Date of Patent: Sep. 7, 2021

(54) METHODS FOR PROCESSING METAL ALLOYS

(71) Applicant: ATI Properties LLC, Albany, OR (US)

(72) Inventors: Robin M. Forbes Jones, Charlotte, NC (US); Ramesh S. Minisandram, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 399 days.

(21) Appl. No.: 14/077,699

(22) Filed: Nov. 12, 2013

(65) Prior Publication Data

US 2015/0129093 A1 May 14, 2015

(51) Int. Cl.
*C21D 8/00* (2006.01)
*C21D 7/13* (2006.01)
(Continued)

(52) U.S. Cl.
CPC ..... *C21D 8/005* (2013.01); *C21D 1/18* (2013.01); *C21D 6/004* (2013.01); *C21D 6/005* (2013.01);
(Continued)

(58) Field of Classification Search
CPC . C21D 8/005; C21D 7/13; C21D 1/18; C21D 2211/001; C21D 2211/004;
(Continued)

(56) References Cited

U.S. PATENT DOCUMENTS 2,857,269 A 10/1958 Vordahl
2,893,864 A 7/1959 Harris et al.
(Continued)

FOREIGN PATENT DOCUMENTS

CA 2787980 A 7/2011
CN 1070230 A 3/1993
(Continued)

OTHER PUBLICATIONS

Forging Machinery, Dies, and Processes, Metals Handbook Desk Edition, ASM International, 1998, p. 839-863 (Year: 1998).*
(Continued)

*Primary Examiner* — Nicholas A Wang
(74) *Attorney, Agent, or Firm* — Robert J. Toth; K&L Gates LLP

(57) ABSTRACT

A method of processing a metal alloy includes heating to a temperature in a working temperature range from a recrystallization temperature of the metal alloy to a temperature less than an incipient melting temperature of the metal alloy, and working the alloy. At least a surface region is heated to a temperature in the working temperature range. The surface region is maintained within the working temperature range for a period of time to recrystallize the surface region of the metal alloy, and the alloy is cooled so as to minimize grain growth. In embodiments including superaustenitic and austenitic stainless steel alloys, process temperatures and times are selected to avoid precipitation of deleterious intermetallic sigma-phase. A hot worked superaustenitic stainless steel alloy having equiaxed grains throughout the alloy is also disclosed.

34 Claims, 9 Drawing Sheets

(51) Int. Cl.

| | |
|---|---|
| ***C21D 1/18*** | (2006.01) |
| ***C22F 1/10*** | (2006.01) |
| ***C22F 1/18*** | (2006.01) |
| ***C22F 1/00*** | (2006.01) |
| ***C22C 38/58*** | (2006.01) |
| ***C22C 38/44*** | (2006.01) |
| ***C22C 38/42*** | (2006.01) |
| ***C22C 38/02*** | (2006.01) |
| ***C22C 38/00*** | (2006.01) |
| ***C22C 38/40*** | (2006.01) |
| ***C22C 19/05*** | (2006.01) |
| ***C22C 30/02*** | (2006.01) |
| ***C21D 6/00*** | (2006.01) |
| ***C21D 8/02*** | (2006.01) |
| *C22C 14/00* | (2006.01) |
| *C22C 19/07* | (2006.01) |

(52) U.S. Cl.

CPC ..... *C21D 7/13* (2013.01); *C21D 8/021* (2013.01); *C21D 8/0247* (2013.01); *C22C 19/056* (2013.01); *C22C 30/02* (2013.01); *C22C 38/002* (2013.01); *C22C 38/004* (2013.01); *C22C 38/02* (2013.01); *C22C 38/40* (2013.01); *C22C 38/42* (2013.01); *C22C 38/44* (2013.01); *C22C 38/58* (2013.01); *C22F 1/002* (2013.01); *C22F 1/10* (2013.01); *C22F 1/183* (2013.01); *C21D 2211/001* (2013.01); *C21D 2211/004* (2013.01); *C22C 14/00* (2013.01); *C22C 19/05* (2013.01); *C22C 19/051* (2013.01); *C22C 19/07* (2013.01)

(58) Field of Classification Search

CPC ..... C21D 6/004; C21D 6/005; C21D 8/021; C21D 8/0247; C22F 1/002; C22F 1/10; C22F 1/183

See application file for complete search history.

(56) References Cited

U.S. PATENT DOCUMENTS

| | | | |
|---|---|---|---|
| 2,932,886 | A | 4/1960 | Althouse |
| 2,974,076 | A | 3/1961 | Vordahl |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |
| 3,313,138 | A | 4/1967 | Spring et al. |
| 3,379,522 | A | 4/1968 | Vordahl |
| 3,436,277 | A | 4/1969 | Bomberger, Jr. et al. |
| 3,469,975 | A | 9/1969 | Bomberger, Jr. et al. |
| 3,489,617 | A | 1/1970 | Wuerfel |
| 3,584,487 | A | 6/1971 | Carlson |
| 3,605,477 | A | 9/1971 | Carlson |
| 3,615,378 | A | 10/1971 | Bomberger, Jr. et al. |
| 3,622,406 | A | 11/1971 | Vordahl |
| 3,635,068 | A | 1/1972 | Watmough et al. |
| 3,649,259 | A | 3/1972 | Heitman |
| 3,676,225 | A | 7/1972 | Owczarski et al. |
| 3,686,041 | A | 8/1972 | Lee |
| 3,802,877 | A | 4/1974 | Parris et al. |
| 3,815,395 | A | 6/1974 | Sass |
| 3,835,282 | A | 9/1974 | Sass et al. |
| 3,867,208 | A | 2/1975 | Grekov et al. |
| 3,922,899 | A | 12/1975 | Fremont et al. |
| 3,979,815 | A | 9/1976 | Nakanose et al. |
| 4,053,330 | A | 10/1977 | Henricks et al. |
| 4,067,734 | A | 1/1978 | Curtis et al. |
| 4,094,708 | A | 6/1978 | Hubbard et al. |
| 4,098,623 | A | 7/1978 | Ibaraki et al. |
| 4,120,187 | A | 10/1978 | Mullen |
| 4,121,953 | A | 10/1978 | Hull |
| 4,138,141 | A | 2/1979 | Andersen |
| 4,147,639 | A | 4/1979 | Lee et al. |
| 4,150,279 | A | 4/1979 | Metcalfe et al. |
| 4,163,380 | A | 8/1979 | Masoner |
| 4,197,643 | A | 4/1980 | Burstone et al. |
| 4,229,216 | A | 10/1980 | Paton et al. |
| 4,299,626 | A | 11/1981 | Paton et al. |
| 4,309,226 | A | 1/1982 | Chen |
| 4,472,207 | A | 9/1984 | Kinoshita et al. |
| 4,473,125 | A | 9/1984 | Addudle et al. |
| 4,482,398 | A | 11/1984 | Eylon et al. |
| 4,510,788 | A | 4/1985 | Ferguson et al. |
| 4,543,132 | A | 9/1985 | Berczik et al. |
| 4,614,550 | A | 9/1986 | Leonard et al. |
| 4,631,092 | A | 12/1986 | Ruckle et al. |
| 4,639,281 | A | 1/1987 | Sastry et al. |
| 4,668,290 | A | 5/1987 | Wang et al. |
| 4,687,290 | A | 8/1987 | Prussas |
| 4,688,290 | A | 8/1987 | Hogg |
| 4,690,716 | A | 9/1987 | Sabol et al. |
| 4,714,468 | A | 12/1987 | Wang et al. |
| 4,798,632 | A | 1/1989 | Yonezawa et al. |
| 4,799,975 | A | 1/1989 | Ouchi et al. |
| 4,808,249 | A | 2/1989 | Eyelon et al. |
| 4,842,653 | A | 6/1989 | Wirth et al. |
| 4,851,055 | A | 7/1989 | Eylon et al. |
| 4,854,977 | A | 8/1989 | Alheritiere et al. |
| 4,857,269 | A | 8/1989 | Wang et al. |
| 4,878,966 | A | 11/1989 | Alheritiere et al. |
| 4,888,973 | A | 12/1989 | Comley |
| 4,889,170 | A | 12/1989 | Mae et al. |
| 4,911,884 | A | 3/1990 | Chang |
| 4,917,728 | A | 4/1990 | Enright |
| 4,919,728 | A | 4/1990 | Kohl et al. |
| 4,943,412 | A | 7/1990 | Bania et al. |
| 4,957,567 | A | 9/1990 | Krueger et al. |
| 4,975,125 | A | 12/1990 | Chakrabarti et al. |
| 4,980,127 | A | 12/1990 | Parris et al. |
| 5,026,520 | A | 6/1991 | Bhowal et al. |
| 5,032,189 | A | 7/1991 | Eylon et al. |
| 5,041,262 | A | 8/1991 | Gigliotti, Jr. |
| 5,074,907 | A | 12/1991 | Amato et al. |
| 5,080,727 | A | 1/1992 | Aihara et al. |
| 5,094,812 | A | 3/1992 | Dulmaine et al. |
| 5,141,566 | A | 8/1992 | Kitayama et al. |
| 5,156,807 | A | 10/1992 | Nagata et al. |
| 5,160,554 | A | 11/1992 | Bania et al. |
| 5,162,159 | A | 11/1992 | Tenhover et al. |
| 5,169,597 | A | 12/1992 | Davidson et al. |
| 5,173,134 | A | 12/1992 | Chakrabarti et al. |
| 5,201,457 | A | 4/1993 | Kitayama et al. |
| 5,244,517 | A | 9/1993 | Kimura et al. |
| 5,256,369 | A | 10/1993 | Ogawa et al. |
| 5,264,055 | A | 11/1993 | Champin et al. |
| 5,277,718 | A | 1/1994 | Paxson et al. |
| 5,310,522 | A | 5/1994 | Culling |
| 5,330,591 | A | 7/1994 | Vasseur |
| 5,332,454 | A | 7/1994 | Meredith et al. |
| 5,332,545 | A | 7/1994 | Love |
| 5,342,458 | A | 8/1994 | Adams et al. |
| 5,358,586 | A | 10/1994 | Schutz |
| 5,359,872 | A | 11/1994 | Nashiki |
| 5,360,496 | A | 11/1994 | Kuhlman et al. |
| 5,374,323 | A | 12/1994 | Kuhlman et al. |
| 5,399,212 | A | 3/1995 | Chakrabarti et al. |
| 5,442,847 | A | 8/1995 | Semiatin et al. |
| 5,472,526 | A | 12/1995 | Gigliotti, Jr. |
| 5,494,636 | A | 2/1996 | Dupioron et al. |
| 5,509,979 | A | 4/1996 | Kimura |
| 5,516,375 | A | 5/1996 | Ogawa et al. |
| 5,520,879 | A | 5/1996 | Saito et al. |
| 5,527,403 | A | 6/1996 | Schirra et al. |
| 5,545,262 | A | 8/1996 | Hardee et al. |
| 5,545,268 | A | 8/1996 | Yashiki et al. |
| 5,547,523 | A | 8/1996 | Blankenship et al. |
| 5,558,728 | A | 9/1996 | Kobayashi et al. |
| 5,580,665 | A | 12/1996 | Taguchi et al. |
| 5,600,989 | A | 2/1997 | Segal et al. |

(56) References Cited

U.S. PATENT DOCUMENTS 5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,904,204 A * 5/1999 Teraoka ..... B22D 11/0622 164/415
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,607,693 B1 8/2003 Saito et al.
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,823,705 B2 11/2004 Fukada et al.
6,908,517 B2 6/2005 Segal et al.
6,918,971 B2 7/2005 Fujii et al.
6,932,877 B2 8/2005 Raymond et al.
6,954,525 B2 10/2005 Deo et al.
6,971,256 B2 12/2005 Okada et al.
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hill
7,081,173 B2 * 7/2006 Bahar ..... C22C 38/005 148/325
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.
7,536,892 B2 5/2009 Amino et al.
7,559,221 B2 7/2009 Horita et al.
7,601,232 B2 10/2009 Fonte
7,611,592 B2 11/2009 Davis et al.
7,708,841 B2 5/2010 Saller
7,837,812 B2 11/2010 Marquardt et al.
7,879,286 B2 2/2011 Miracle et al.
7,947,136 B2 5/2011 Saller
7,984,635 B2 7/2011 Callebaut et al.
8,037,730 B2 10/2011 Polen et al.
8,048,240 B2 11/2011 Hebda et al.
8,128,764 B2 3/2012 Miracle et al.
8,226,568 B2 7/2012 Watson et al.
8,311,706 B2 11/2012 Lu et al.
8,316,687 B2 11/2012 Slattery
8,336,359 B2 12/2012 Werz
8,408,039 B2 4/2013 Cao et al.
8,454,765 B2 6/2013 Saller
8,499,605 B2 8/2013 Bryan
8,551,264 B2 10/2013 Kosaka et al.
8,578,748 B2 11/2013 Huskamp et al.
8,679,269 B2 3/2014 Goller et al.
8,919,168 B2 12/2014 Valiev et al.
9,034,247 B2 5/2015 Suzuki et al.
9,327,342 B2 5/2016 Oppenheimer et al.
9,732,408 B2 8/2017 Sanz et al.
2002/0033717 A1 3/2002 Matsuo
2002/0189399 A1 * 12/2002 Grubb ..... C21D 1/26 75/10.25
2003/0168138 A1 9/2003 Marquardt
2004/0050463 A1 * 3/2004 Jung ..... C21D 6/004 148/608
2004/0099350 A1 5/2004 Manitone et al.
2004/0148997 A1 8/2004 Amino et al.
2004/0206427 A1 * 10/2004 Iseda ..... C21D 6/004 148/609
2004/0221929 A1 11/2004 Hebda et al.
2004/0250932 A1 12/2004 Briggs
2005/0028905 A1 2/2005 Riffee, Jr.
2005/0047952 A1 3/2005 Coleman
2005/0145310 A1 7/2005 Bewlay et al.
2006/0045789 A1 3/2006 Nasserrafi et al.
2006/0110614 A1 5/2006 Liimatainen
2006/0243356 A1 11/2006 Oikawa et al.
2007/0009858 A1 1/2007 Hatton et al.
2007/0017273 A1 1/2007 Haug et al.
2007/0098588 A1 * 5/2007 Narita ..... C22C 38/001 420/57
2007/0178322 A1 * 8/2007 Chun et al. ..... 428/469
2007/0193662 A1 8/2007 Jablokov et al.
2007/0286761 A1 12/2007 Miracle et al.
2008/0000554 A1 1/2008 Yaguchi et al.
2008/0103543 A1 5/2008 Li et al.
2008/0107559 A1 5/2008 Nishiyama et al.
2008/0202189 A1 8/2008 Otaki
2008/0210345 A1 9/2008 Tetyukhin et al.
2008/0264932 A1 10/2008 Hirota
2009/0000706 A1 1/2009 Huron et al.
2009/0183804 A1 7/2009 Zhao et al.
2009/0234385 A1 9/2009 Cichocki et al.
2010/0147247 A1 * 6/2010 Qiao ..... C22C 38/02 123/188.3
2010/0170596 A1 * 7/2010 Saller et al. ..... 148/566
2010/0307647 A1 12/2010 Marquardt et al.
2011/0038751 A1 2/2011 Marquardt et al.
2011/0180188 A1 7/2011 Bryan et al.
2011/0183151 A1 7/2011 Yokoyama et al.
2011/0290665 A1 * 12/2011 Shim ..... 205/726
2012/0003118 A1 1/2012 Hebda et al.
2012/0012233 A1 1/2012 Bryan

(56) References Cited

U.S. PATENT DOCUMENTS

| | | | |
|---|---|---|---|
| 2012/0060981 | A1 | 3/2012 | Forbes Jones et al. |
| 2012/0067100 | A1 | 3/2012 | Stefansson et al. |
| 2012/0076611 | A1 | 3/2012 | Bryan |
| 2012/0076612 | A1 | 3/2012 | Bryan |
| 2012/0076686 | A1 | 3/2012 | Bryan |
| 2012/0177532 | A1 | 7/2012 | Hebda et al. |
| 2012/0279351 | A1 | 11/2012 | Gu et al. |
| 2012/0308428 | A1 | 12/2012 | Forbes Jones et al. |
| 2013/0062003 | A1 | 3/2013 | Shulkin et al. |
| 2013/0118653 | A1 | 5/2013 | Bryan et al. |
| 2013/0156628 | A1 | 6/2013 | Forbes Jones et al. |
| 2013/0291616 | A1 | 11/2013 | Bryan |
| 2014/0060138 | A1 | 3/2014 | Hebda et al. |
| 2014/0076468 | A1 | 3/2014 | Marquardt et al. |
| 2014/0076471 | A1 | 3/2014 | Forbes Jones et al. |
| 2014/0116582 | A1 | 5/2014 | Forbes Jones et al. |
| 2014/0238552 | A1 | 8/2014 | Forbes Jones et al. |
| 2014/0255719 | A1 | 9/2014 | Forbes Jones et al. |
| 2014/0260492 | A1 | 9/2014 | Thomas et al. |
| 2014/0261922 | A1 | 9/2014 | Thomas et al. |
| 2016/0047024 | A1 | 2/2016 | Bryan |
| 2016/0122851 | A1 | 5/2016 | Jones et al. |
| 2016/0138149 | A1 | 5/2016 | Bryan |
| 2016/0201165 | A1 | 7/2016 | Foltz, IV |
| 2017/0058387 | A1 | 3/2017 | Marquardt et al. |
| 2017/0146046 | A1 | 5/2017 | Foltz, IV |
| 2017/0218485 | A1 | 8/2017 | Jones et al. |
| 2017/0321313 | A1 | 11/2017 | Thomas et al. |
| 2017/0349977 | A1 | 12/2017 | Forbes Jones et al. |
| 2018/0016670 | A1 | 1/2018 | Bryan |
| 2018/0073092 | A1 | 3/2018 | Forbes Jones et al. |
| 2018/0195155 | A1 | 7/2018 | Bryan |
| 2020/0032833 | A1 | 1/2020 | Foltz, IV et al. |
| 2020/0347483 | A1 | 11/2020 | Foltz, IV |

FOREIGN PATENT DOCUMENTS

| | | | | |
|---|---|---|---|---|
| CN | 1194671 | A | 9/1998 | |
| CN | 1403622 | | 3/2003 | |
| CN | 1816641 | A | 8/2006 | |
| CN | 101104898 | A | 1/2008 | |
| CN | 101205593 | A | 6/2008 | |
| CN | 101294264 | A | 10/2008 | |
| CN | 101684530 | A | 3/2010 | |
| CN | 101637789 | B | 6/2011 | |
| CN | 102212716 | A | 10/2011 | |
| CN | 102816953 | A | 12/2012 | |
| DE | 19743802 | A1 | 3/1999 | |
| DE | 10128199 | A1 | 12/2002 | |
| DE | 102010009185 | A1 | 11/2011 | |
| EP | 0066361 | A2 | 12/1982 | |
| EP | 0109350 | A2 | 5/1984 | |
| EP | 0320820 | A1 | 6/1989 | |
| EP | 0535817 | B1 | 4/1995 | |
| EP | 0611831 | B1 | 1/1997 | |
| EP | 0834580 | A1 | 4/1998 | |
| EP | 0870845 | A1 | 10/1998 | |
| EP | 0707085 | B1 | 1/1999 | |
| EP | 0683242 | B1 | 5/1999 | |
| EP | 0969109 | A1 | 1/2000 | |
| EP | 1083243 | A2 | 3/2001 | |
| EP | 1136582 | A1 | 9/2001 | |
| EP | 1302554 | A1 | 4/2003 | |
| EP | 1302555 | A1 | 4/2003 | |
| EP | 1433863 | | 6/2004 | |
| EP | 1471158 | A1 | 10/2004 | |
| EP | 1605073 | A1 | 12/2005 | |
| EP | 1612289 | A2 | 1/2006 | |
| EP | 1375690 | B1 | 3/2006 | |
| EP | 1717330 | A1 | 11/2006 | |
| EP | 1882752 | A2 | 1/2008 | |
| EP | 2028435 | A1 | 2/2009 | |
| EP | 2281908 | A1 | 2/2011 | |
| EP | 1546429 | B1 | 6/2012 | |
| FR | 2545104 | A1 | 11/1984 | |
| GB | 847103 | | 9/1960 | |
| GB | 1170997 | A | 11/1969 | |
| GB | 1345048 | | 1/1974 | |
| GB | 1433306 | | 4/1976 | |
| GB | 1479855 | | 7/1977 | |
| GB | 2151260 | A | 7/1985 | |
| GB | 2198144 | A | 6/1988 | |
| GB | 2337762 | A | 12/1999 | |
| JP | 55-113865 | A | 9/1980 | |
| JP | 57-62820 | A | 4/1982 | |
| JP | 57-62846 | A | 4/1982 | |
| JP | S57-202935 | A | 12/1982 | |
| JP | S58-210156 | A | 12/1983 | |
| JP | S58-210158 | A | 12/1983 | |
| JP | 60-046358 | | 3/1985 | |
| JP | 60-100655 | A | 6/1985 | |
| JP | S60-190519 | A | 9/1985 | |
| JP | S61-060871 | | 3/1986 | |
| JP | S61-217564 | A | 9/1986 | |
| JP | S61270356 | * | 11/1986 | |
| JP | 62-109956 | A | 5/1987 | |
| JP | 62-127074 | A | 6/1987 | |
| JP | 62-149859 | A | 7/1987 | |
| JP | S62-227597 | A | 10/1987 | |
| JP | S62-247023 | A | 10/1987 | |
| JP | S63-49302 | A | 3/1988 | |
| JP | S63-188426 | A | 8/1988 | |
| JP | H01-272750 | A | 10/1989 | |
| JP | 1-279736 | A | 11/1989 | |
| JP | 2-205661 | A | 8/1990 | |
| JP | 3-134124 | A | 6/1991 | |
| JP | H03-138343 | A | 6/1991 | |
| JP | H03-155427 | A | 7/1991 | |
| JP | H03-166350 | A | 7/1991 | |
| JP | 03264618 | A * | 11/1991 | ..... C21D 8/00 |
| JP | H03-264618 | A | 11/1991 | |
| JP | 4-74856 | A | 3/1992 | |
| JP | 4-103737 | A | 4/1992 | |
| JP | 4-143236 | A | 5/1992 | |
| JP | 4-168227 | A | 6/1992 | |
| JP | 5-59510 | A | 3/1993 | |
| JP | 5-117791 | A | 5/1993 | |
| JP | 5-195175 | A | 8/1993 | |
| JP | H05-293555 | A | 11/1993 | |
| JP | H06-93389 | A | 4/1994 | |
| JP | 8-300044 | A | 11/1996 | |
| JP | 9-143650 | | 6/1997 | |
| JP | 9-194969 | A | 7/1997 | |
| JP | 9-215786 | A | 8/1997 | |
| JP | H10-128459 | A | 5/1998 | |
| JP | H10-306335 | A | 11/1998 | |
| JP | H11-21642 | A | 1/1999 | |
| JP | H11-309521 | A | 11/1999 | |
| JP | H11-319958 | A | 11/1999 | |
| JP | 11-343528 | A | 12/1999 | |
| JP | 11-343548 | A | 12/1999 | |
| JP | 2000-153372 | A | 6/2000 | |
| JP | 2000-234887 | A | 8/2000 | |
| JP | 2001-71037 | A | 3/2001 | |
| JP | 2001-081537 | A | 3/2001 | |
| JP | 2001-343472 | A | 12/2001 | |
| JP | 2002-69591 | A | 3/2002 | |
| JP | 2002-146497 | A | 5/2002 | |
| JP | 2003-55749 | A | 2/2003 | |
| JP | 2003-73762 | A | 3/2003 | |
| JP | 2003-74566 | A | 3/2003 | |
| JP | 2003-285126 | A | 10/2003 | |
| JP | 2003-334633 | A | 11/2003 | |
| JP | 2004-131761 | | 4/2004 | |
| JP | 2005-281855 | A | 10/2005 | |
| JP | 2007-291488 | A | 11/2007 | |
| JP | 2007-327118 | A | 12/2007 | |
| JP | 2008-200730 | A | 9/2008 | |
| JP | 2009-138218 | A | 6/2009 | |
| JP | 2009-167502 | A | 7/2009 | |
| JP | WO 2009/142228 | A1 | 11/2009 | |
| JP | 2009-299110 | A | 12/2009 | |
| JP | 2009-299120 | A | 12/2009 | |
| JP | 2010-70833 | A | 4/2010 | |

(56) References Cited

FOREIGN PATENT DOCUMENTS

| | | | | |
|---|---|---|---|---|
| JP | 2012-140690 | A | | 7/2012 |
| JP | 2012-180542 | A | | 9/2012 |
| JP | 2015-54332 | A | | 3/2015 |
| KR | 920004946 | | | 6/1992 |
| KR | 10-2005-0087765 | A | | 8/2005 |
| KR | 10-2009-0069647 | A | | 7/2009 |
| KR | 10-2011-0069602 | A | | 6/2011 |
| KR | 20110069602 | | * | 6/2011 |
| RU | 2003417 | C1 | | 11/1993 |
| RU | 1131234 | C | | 10/1994 |
| RU | 2156828 | C1 | | 9/2000 |
| RU | 2197555 | C1 | | 7/2001 |
| RU | 2172359 | C1 | | 8/2001 |
| RU | 2217260 | C1 | | 11/2003 |
| RU | 2234998 | C1 | | 8/2004 |
| RU | 2256713 | C1 | | 7/2005 |
| RU | 2269584 | C1 | | 2/2006 |
| RU | 2288967 | C1 | | 12/2006 |
| RU | 2364660 | C1 | | 8/2009 |
| RU | 2368695 | C1 | | 9/2009 |
| RU | 2378410 | C1 | | 1/2010 |
| RU | 2392348 | C2 | | 6/2010 |
| RU | 2393936 | C1 | | 7/2010 |
| RU | 2413030 | C1 | | 2/2011 |
| RU | 2441089 | C1 | | 1/2012 |
| RU | 2447185 | C1 | | 4/2012 |
| SU | 534518 | A1 | | 1/1977 |
| SU | 631234 | A | | 11/1978 |
| SU | 1077328 | A | | 5/1982 |
| SU | 1135798 | A1 | | 1/1985 |
| SU | 1088397 | A1 | | 2/1991 |
| UA | 38805 | A | | 5/2001 |
| UA | 40862 | A | | 8/2001 |
| UA | a200613448 | | | 6/2008 |
| WO | H03-274238 | A | | 12/1991 |
| WO | WO 98/17386 | A1 | | 4/1998 |
| WO | WO 98/17836 | A1 | | 4/1998 |
| WO | WO 98/22629 | A | | 5/1998 |
| WO | WO 02/36847 | A2 | | 5/2002 |
| WO | WO 02/070763 | A1 | | 9/2002 |
| WO | WO 02/086172 | A1 | | 10/2002 |
| WO | WO 02/090607 | A1 | | 11/2002 |
| WO | WO 2004/101838 | A1 | | 11/2004 |
| WO | WO 2007/084178 | A2 | | 7/2007 |
| WO | WO 2007/114439 | A1 | | 10/2007 |
| WO | WO 2007/142379 | A1 | | 12/2007 |
| WO | WO 2008/017257 | A1 | | 2/2008 |
| WO | WO 2008/071192 | A1 | | 7/2008 |
| WO | WO 2009/082498 | A1 | | 7/2009 |
| WO | WO 2009/102233 | A1 | | 8/2009 |
| WO | WO 2010/084883 | A1 | | 7/2010 |
| WO | WO 2012/063504 | A1 | | 5/2012 |
| WO | WO 2012/147742 | A1 | | 11/2012 |
| WO | WO 2013/081770 | A1 | | 6/2013 |
| WO | WO 2013/130139 | A2 | | 9/2013 |

OTHER PUBLICATIONS

Types of Heat-Treating Furnaces. ASM Handbook, vol. 4: Heat-Treating. 1991. p. 465-474 (Year: 1991).*

ACOM Magazine, pp. 1-16, published in Feb. 2013.

David N. French Sc. D, "Austenitic Stainless Steel," 3 pages, published winter of 1992 in the National Board of Boiler and Pressure Vessel Inspectors Bulletin.

Superaustenitic, 3 pages, retrieved on Nov. 9, 2015, and available at http://www.atimetals.com/products/Pages/superaustenitic.aspx.

Hsieh and Wu, "Overview of Intermetallic Sigma Phase Precipitation in Stainless Steel," 10 pages, available in ISRN Metallurgy vol. 2012 (2012).

Yaylaci et al., "Cold Working & Hot Working & Annealing," slides 1-40, published in 2010 and retrieved on Dec. 10, 2015, available at http://yunus.hacettepe.edu.tr/~selis/teaching/WEBkmu479/Ppt/kmu479Presentations2010/Cold_Hot_Working_Annealing.pdf.

INCONEL Alloy 600, pp. 1-16, published in Sep. 2008 by Special Metals Corporation, and available at www.specialmetals.com.

Daniel H. Herring "Grain size and its Influence on Materials Properties," pp. 20 and 22, published in Aug. 2005, and available at industrialheating.com.

ASM Materials Engineering Dictionary, "Blasting or Blast Cleaning," J.R. Davis Ed., ASM International, Materials Park, OH (1992) p. 42.

ATI 38-644™ Beta Titanium Alloy Technical Data Sheet, UNA R58640, Version 1, Dec. 21, 2011, 4 pages.

ATI 425® Alloy, Grade 38, Titanium Alloy, UNS R54250, Technical Data Sheet, Version 1, Nov. 25, 2013, pp. 1-6.

Beal et al., "Forming of Titanium and Titanium Alloys-Cold Forming", ASM Handbook, 2006, vol. 14B, pp. 656-669.

Craighead et al., "Ternary Alloys of Titanium", Journal of Metals, Mar. 1950, Transactions AIME, vol. 188, pp. 514-538.

Craighead et al., "Titanium Binary Alloys", Journal of Metals, Mar. 1950, Transactions AIME, vol. 188, pp. 485-513.

Diderrich et al., "Addition of Cobalt to the Ti—6Al—4V Alloy", Journal of Metals, May 1968, pp. 29-37.

Donachie Jr., M.J., "Heat Treating Titanium and Its Alloys", Heat Treating Process, Jun./Jul. 2001, pp. 47-49, 52-53, and 56-57.

Glazunov et al., Structural Titanium Alloys, Moscow, Metallurgy, 1974, pp. 264-283.

Novikov et al., 17.2.2 Deformable ($\alpha+\beta$) alloys, Chapter 17, Titanium and its Alloys, Metal Science, vol. II Thermal Treatment of the Alloy, Physical Matallurgy, 2009, pp. 357-360.

Swann, P.R. and J. G. Parr, "Phase Transformations in Titanium-Rich Alloys of Titanium and Cobalt", Transactions of the Metallurgical Society of AIME, Apr. 1958, pp. 276-279.

Ti—6Al—4V, Ti64, 6Al—4V, 6-4, UNA R56400, 1 page.

Titanium 3Al—8V—6Cr—4Mo—4Zr Beta-C/Grade 19 UNS R58640, 2 pages.

Yakymyshyn et al., "The Relationship between the Constitution and Mechanical Properties of Titanium-Rich Alloys of Titanium and Cobalt", 1961, vol. 53, pp. 283-294.

AFML-TR-76-80 Development of Titanium Alloy Casting Technology, Aug. 1976, 5 pages.

Valiev et al., "Nanostructured materials produced by sever plastic deformation", Moscow, LOGOS, 2000.

Li et al., "The optimal determination of forging process parameters for Ti—6.5Al—3.5Mo—1.5Zr—0.3Si alloy with thick lamellar microstructure in two phase field based on P-map", Journal of Materials Processing Technology, vol. 210, Issue 2, Jan. 19, 2010, pp. 370-377.

Buijk, A., "Open-Die Forging Simulation", Forge Magazine, Dec. 1, 2013, 5 pages.

Herring, D., "Grain Size and Its Influence on Materials Properties", IndustrialHeating.com, Aug. 2005, pp. 20 and 22.

INCONEL® alloy 600, Special Metals Corporation, www.specialmetals.com, Sep. 2008, 16 pages.

Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.

Superaustenitic, http://www.atimetals.com/products/Pages/superaustenitic.aspx, Nov. 9, 2015, 3 pages.

French, D., "Austenitic Stainless Steer", The National Board of Boiler and Pressure Vessel Inspectors Bulletin,1992, 3 pages.

Acom Magazine, outokumpu, NACE International, Feb. 2013, 16 pages.

ATI A286™ Iron Based Superalloy (UNS S66286) Technical Data Sheet, Allegheny Technologies Incorporated, Version 1, Apr. 17, 2012, 9 pages.

ATI A286™ (UNS S66286) Technical Data Sheet, Allegheny Technologies Incorporated, Version 1, Mar. 14, 2012, 3 pages.

Corrosion-Resistant Titanium, Technical Data Sheet, Allegheny Technologies Incorporated, Version 1, Feb. 29, 2012, 5 pages.

ATI 3-2.5™ Titanium (Ti Grade 9) Technical Data Sheet, ATI Wah Chang, 2010, 4 pages.

Grade 9 Ti 3Al 2.5V Alloy (UNA R56320), Jul. 30, 2013. http://www.azom.com/article.aspx?ArticleID=9337, 3 pages.

(56) References Cited

OTHER PUBLICATIONS

ATI Ti—6Al—4V, Grade 5. Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy. Jul. 9, 2013, http://www.azom.com/article.aspx?ArticleID=9448. 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al.. "Superplastic Forming Properties of Timetal® 54M", Henderson Technical Laboratory, Titanium Metals Corporation, ITA, Oct. 2010, Orlando, Florida, 18 pages.
Office Action dated Apr. 23, 2015 in U.S. Appl. No. 12/691,952.
Office Action dated Jul. 28, 2015 in U.S. Appl. No. 12/691,952.
Advisory Action dated May 18, 2015 in U.S. Appl. No. 12/885,620.
Office Action dated Jun. 30, 2015 in U.S. Appl. No. 12/885,620.
Notice of Abandonment dated Jan. 29, 2016 in U.S. Appl. No. 12/885,620.
Office Action dated May 27, 2015 in U.S. Appl. No. 12/838,674.
Applicant Initiated Interview Summary dated Sep. 1, 2015 in U.S. Appl. No. 12/838,674.
Notice of Allowance dated Sep. 25, 2015 in U.S. Appl. No. 12/838,674.
Office Action dated Jul. 15, 2015 in U.S. Appl. No. 12/903,851.
Office Action dated Jun. 4, 2015 in U.S. Appl. No. 13/792,285.
Notice of Allowance dated Sep. 16, 2015 in U.S. Appl. No. 13/792,285.
Response to Rule 312 Communication dated Oct. 20, 2015 in U.S. Appl. No. 13/792,285.
U.S. Appl. No. 14/594,300, filed Jan. 12, 2015.
Office Action dated Jun. 3, 2015 in U.S. Appl. No. 13/714,465.
Office Action dated Jul. 8, 2015 in U.S. Appl. No. 13/714,465.
Notice of Allowance dated Sep. 2, 2015 in U.S. Appl. No. 13/714,465.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Office Action dated Jun. 26, 2015 in U.S. Appl. No. 13/777,066.
Office Action dated Oct. 5, 2015 in U.S. Appl. No. 13/777,066.
Office Action dated Aug. 19, 2015 in U.S. Appl. No. 13/844,196.
Office Action dated Oct. 15, 2015 in U.S. Appl. No. 13/844,196.
Office Action dated Oct. 2, 2015 in U.S. Appl. No. 14/073,029.
Office Action dated Oct. 28, 2015 in U.S. Appl. No. 14/093,707.
ATI Datalloy HP™ Alloy, UNS N08830, Technical Data Sheet Version 1, Apr. 14, 2015, 6 pages.
ATI Datalloy 2® Alloy, Technical Data Sheet, Version 1, Feb. 20, 2014, 6 pages.
Beal et al., "Forming of Titanium and Titanium Alloys-Cold Forming", ASM Handbook, 2006, ASM International, Revised by ASM Committee on Forming Titanium Alloys, vol. 14B, 2 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
Office Action dated Dec. 23, 2014 in U.S. Appl. No. 12/691,952.
Office Action dated Nov. 28, 2014 in U.S. Appl. No. 12/885,620.
Office Action dated Oct. 6, 2014 in U.S. Appl. No. 12/903,851.
Office Action dated Jan. 21, 2015 in U.S. Appl. No. 13/792,285.
Notice of Allowance dated Oct. 24, 2014 in U.S. Appl. No. 13/844,545.
Notice of Allowance dated Feb. 6, 2015 in U.S. Appl. No. 13/844,545.
Hsieh, Chih-Chun and Weite Wu, "Overview of Intermetallic Sigma Phase Precipitation in Stainless Steels", ISRN Metallurgy, vol. 2012, 2012, pp. 1-16.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Office Action dated Feb. 17, 2016 in U.S. Appl. No. 12/691,952.
Office Action dated Jun. 28, 2016 in U.S. Appl. No. 12/691,952.
Office Action dated Mar. 30, 2016 in U.S. Appl. No. 13/108,045.
Advisory Action Before the Filing of an Appeal Brief dated Mar. 17, 2016 in U.S. Appl. No. 13/777,066.
Office Action dated Jul. 22, 2016 in U.S. Appl. No. 13/777,066.
Office Action dated Feb. 12, 2016 in U.S. Appl. No. 13/844,196.
Advisory Action Before the Filing of an Appeal Brief dated Jun. 15, 2016 in U.S. Appl. No. 13/844,196.
Office Action dated Mar. 17, 2016 in U.S. Appl. No. 14/093,707.
Advisory Action Before the Filing of an Appeal Brief dated Jun. 10, 2016 in U.S. Appl. No. 14/093,707.
Office Action dated Mar. 16, 2016 in U.S. Appl. No. 15/005,281.
U.S. Appl. No. 14/948,941, filed Nov. 23, 2015.
Office Action dated Apr. 5, 2016 in U.S. Appl. No. 14/028,588.
Office Action dated Apr. 13, 2016 in U.S. Appl. No. 14/083,759.
Office Action dated May 6, 2016 in U.S. Appl. No. 14/083,759.
ASTM Designation F 2066/F2066M-13, "Standard Specification for Wrought Titanium-15 Molybdenum Alloy for Surgical Implant Applications (UNS R58150)", Nov. 2013, 6 pages.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Advisory Action Before the Filing of an Appeal Brief dated Jan. 30, 2014 in U.S. Appl. No. 12/885,620.
Office Action dated Jun. 18, 2014 in U.S. Appl. No. 12/885,620.
Office Action dated Jan. 16, 2014 in U.S. Appl. No. 12/903,851.
Office Action dated Jan. 17, 2014 in U.S. Appl. No. 13/108,045.
Supplemental Notice of Allowability dated Jan. 17, 2014 in U.S. Appl. No. 13/150,494.
Notice of Allowance dated May 6, 2014 in U.S. Appl. No. 13/933,222.
U.S. Appl. No. 13/844,545, filed Mar. 15, 2013.
Arjaan Buijk, "Open-Die Forging Simulation," FORGE Magazine, 5 pages, Dec. 1, 2013.
"Allvac TiOsteum and TiOstalloy Beat Titanium Alloys", printed from www.allvac.com/allvac/pages/Titanium/TiOsteum.htm on Nov. 7, 2005.
"Datasheet: Timetal 21S", Alloy Digest, Advanced Materials and Processes (Sep. 1998), pp. 38-39.
"Heat Treating of Nonferrous Alloys: Heat Treating of Titanium and Titanium Alloys," Metals Handbook, ASM Handbooks Online (2002).
"Stryker Orthopaedics TMZF® Alloy (UNS R58120)", printed from www.allvac.com/allvac/pages/Titanium/UNSR58120.htm on Nov. 7, 2005.
"Technical Data Sheet: Allvac® Ti—15Mo Beta Titanium Alloy" (dated Jun. 16, 2004).
"ASTM Designation F1801-97 Standard Practice for Corrosion Fatigue Testing of Metallic Implant Materials" ASTM International (1997) pp. 876-880.
"ASTM Designation F2066-01 Standard Specification for Wrought Titanium-15 Molybdenum Alloy for Surgical Implant Applications (UNA R58150)," ASTM International (2000) pp. 1-4.
AL-6XN® Alloy (UNS N08367) Allegheny Ludlum Corporation, 2002, 56 pages.

(56) References Cited

OTHER PUBLICATIONS

Allegheny Ludlum, "High Performance Metals for Industry, High Strength, High Temperature, and Corrosion-Resistant Alloys", (2000) pp. 1-8.
Allvac, Product Specification for "Allvac Ti-15 Mo," available at http://www.allvac.com/allvac/pages/Titanium/Ti15MO.htm, last visited Jun. 9, 2003 p. 1 of 1.
Altemp® A286 Iron-Base Superalloy (UNS Designation S66286) Allegheny Ludlum Technical Data Sheet Blue Sheet, 1998, 8 pages.
ASM Materials Engineering Dictionary, J.R. Davis Ed., ASM International, Materials Park, OH (1992) p. 39.
ATI Datalloy 2 Alloy, Technical Data Sheet, ATI Allvac, Monroe, NC, SS-844, Version1, Sep. 17, 2010, 8 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066-01, "Standard Specification for Wrought Titanium-15 Molybdenum Alloy for Surgical Implant Applications (UNS R58150)", May 2001, 7 pages.
ATI 6-2-4-2™ Alloy Technical Data Sheet, Version 1, Feb. 26, 2012, 4 pages.
ATI 6246™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 500-MIL™ , Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™ , Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe—0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys-Cold Forming", ASM Handbook, 2006, ASM International, vol. 14B, 2 pages.
Bewlay, et al., "Superplastic roll forming of Ti alloys", Materials and Design, 21, 2000, pp. 287-295.
Bowen, A. W., "Omega Phase Embrittlement in Aged Ti—15% Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Desrayaud et al., "A novel high straining process for bulk materials—The development of a multipass forging system by compression along three axes", Journal of Materials Processing Technology, 172, 2006, pp. 152-158.
DiDomizio, et al., "Evaluation of a Ni—20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-17.
Disegi, John, Wrought Titanium—15% Molybdenum Implant Material, Original Instruments and Implants of the Association for the Study of International Fixation—AO ASIF, Oct. 2003.
Donachie Jr., M.J., "Titanium A Technical Guide" 1988, ASM, pp. 39 and 46-50.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.

(56) References Cited

OTHER PUBLICATIONS

Imperial Metal Industries Limited, Product Specification for "IMI Titanium 205", The Kynoch Press (England) pp. 1-5. (publication date unknown).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti—15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", Wear, 249(1-2), Jan. 17, 2001, 158-168.
Lutjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications," Journal of ASTM International, vol. 2, Issue 9 (Oct. 2005) (published online Aug. 17, 2005).
Marquardt, Brian, "Characterization of Ti—15Mo for Orthopaedic Applications, "TMS 2005 Annual Meeting: Technical Program, San Francisco, CA, Feb. 13-17, 2005 Abstract, p. 239.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni-20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massaiski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy, "Titanium '80 Science and Technology-Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Nutt, Michael J. et al., "The Application of Ti-15 Beta Titanium Alloy in High Strength Structural Orthopaedic Applications, "Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti-6A1-4V ELI, Ti-6A1-7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti—62425", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for

(56) References Cited

OTHER PUBLICATIONS

Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V—xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
TIMET 6-6-2 Titanium Alloy (Ti—6Al—6V—2Sn), Annealed, accessed Jun. 27, 2012.
TIMET Timetal® 6-2-4-2 (Ti—6Al—2Sn—4Zr—2Mo—0.08Si) Titanium Alloy datasheet, accessed Jun. 26, 2012.
TIMET Timetal® 6-2-4-6 Titanium Alloy (Ti—6Al—2Sn—4Zr—6Mo), Typical, accessed Jun. 26, 2012.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Two new α-βtitanium alloys, KS Ti—9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6AI-4V, Annealed, AMS 4911L, Jun. 2007, SAE Aerospace, Aerospace Material Specification, 7 pages.
Office Action dated Oct. 19, 2011 in U.S. Appl. No. 12/691,952.
Office Action dated Feb. 2, 2012 in U.S. Appl. No. 12/691,952.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Dec. 16, 2004 in U.S. Appl. No. 10/434,598.
Office Action dated Aug. 17, 2005 in U.S. Appl. No. 10/434,598.
Office Action dated Dec. 19, 2005 in U.S. Appl. No. 10/434,598.
Office Action dated Sep. 6, 2006 in U.S. Appl. No. 10/434,598.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
Notice of Allowance dated Sep. 20, 2010 in U.S. Appl. No. 11/448,160.
Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Jun. 21, 2010 in U.S. Appl. No. 11/057,614.
Notice of Allowance dated Sep. 3, 2010 in U.S. Appl. No. 11/057,614.
Office Action dated Apr. 1, 2010 in U.S. Appl. No. 11/745,189.
Interview summary dated Jun. 3, 2010 in U.S. Appl. No. 11/745,189.
Interview summary dated Jun. 15, 2010 in U.S. Appl. No. 11/745,189.
Office Action dated Nov. 24, 2010 in U.S. Appl. No. 11/745,189.
Interview summary dated Jan. 6, 2011 in U.S. Appl. No. 11/745,189.
Notice of Allowance dated Jun. 27, 2011 in U.S. Appl. No. 11/745,189.
Office Action dated Jan. 11, 2011 in U.S. Appl. No. 12/911,947.
Office Action dated Aug. 4, 2011 in U.S. Appl. No. 12/911,947.
Office Action dated Nov. 16, 2011 in U.S. Appl. No. 12/911,947.
Advisory Action dated Jan. 25, 2012 in U.S. Appl. No. 12/911,947.
Notice of Panel Decision from Pre-Appeal Brief Review dated Mar. 28, 2012 in U.S. Appl. No. 12/911,947.
Office Action dated Apr. 5, 2012 in U.S. Appl. No. 12/911,947.
Office Action dated Sep. 19, 2012 in U.S. Appl. No. 12/911,947.
Advisory Action dated Nov. 29, 2012 in U.S. Appl. No. 12/911,947.
Office Action dated May 31, 2013 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7, 2011 in U.S. Appl. No. 12/857,789.
Notice of Allowance dated Jul. 1, 2013 in U.S. Appl. No. 12/857,789.
Office Action dated Nov. 14, 2012 in U.S. Appl. No. 12/885,620.
Office Action dated Jun. 13, 2013 in U.S. Appl. No. 12/885,620.
Office Action dated Nov. 14, 2012 in U.S. Appl. No. 12/888,699.
Office Action dated Oct. 3, 2012 in U.S. Appl. No. 12/838,674.
Office Action dated Jul. 18, 2013 in U.S. Appl. No. 12/838,674.
Office Action dated Sep. 26, 2012 in U.S. Appl. No. 12/845,122.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31, 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 1, 2013 in U.S. Appl. No. 12/903,851.
Office Action dated Mar. 25, 2013 in U.S. Appl. No. 13/108,045.
Office Action dated Apr. 16, 2013 in U.S. Appl. No. 13/150,494.
Office Action dated Jun. 14, 2013 in U.S. Appl. No. 13/150,494.
U.S. Appl. No. 13/777,066, filed Feb. 26, 2013.
U.S. Appl. No. 13/331,135, filed Dec. 20, 2011.

(56) References Cited

OTHER PUBLICATIONS

U.S. Appl. No. 13/792,285, filed Mar. 11, 2013.
U.S. Appl. No. 13/844,196, filed Mar. 15, 2013.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
Notice of Allowance dated Oct. 4, 2013 in U.S. Appl. No. 12/911,947.
Notice of Allowance dated Nov. 5, 2013 in U.S. Appl. No. 13/150,494.
U.S. Appl. No. 13/933,222, filed Mar. 15, 2013.
Office Action dated Sep. 6, 2013 in U.S. Appl. No. 13/933,222.
Notice of Allowance dated Oct. 1, 2013 in U.S. Appl. No. 13/933,222.
U.S. Appl. No. 14/077,699, filed Nov. 12, 2013.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™ /ATI 800H™ /ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Office Action dated Nov. 19, 2013 in U.S. Appl. No. 12/885,620.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Applicant-Initiated Interview Summary dated Aug. 22, 2016 in U.S. Appl. No. 12/691,952.
Advisory Action Before the Filing of an Appeal Brief dated Aug. 30, 2016 in U.S. Appl. No. 12/691,952.
Office Action dated Sep. 9, 2016 in U.S. Appl. No. 13/108,045.
Office Action dated Aug. 22, 2016 in U.S. Appl. No. 13/844,196.
Office Action dated Aug. 12, 2016 in U.S. Appl. No. 14/073,029.
Office Action dated Sep. 30, 2016 in U.S. Appl. No. 14/093,707.
Office Action dated Aug. 26, 2016 in U.S. Appl. No. 15/005,281.
Office Action dated Aug. 8, 2016 in U.S. Appl. No. 14/028,588.
Srinivasan et al., "Rolling of Plates and Sheets from As-Cast Ti—6Al—4V—0.1 B", Journal of Materials Engineering and Performance, vol. 18.4, Jun. 2009, pp. 390-398.
Office Action dated Apr. 28, 2017 in U.S. Appl. No. 12/691,952.
Office Action dated Jul. 10, 2017 in U.S. Appl. No. 12/691,952.
Office Action dated May 18, 2017 in U.S. Appl. No. 13/777,066.
Advisory Action Before the Filing of an Appeal Brief dated Jul. 10, 2017 in U.S. Appl. No. 13/777,066.
Notice of Allowance dated Jul. 13, 2017 in U.S. Appl. No. 13/844,196.
Corrected Notice of Allowability dated Jul. 20, 2017 in U.S. Appl. No. 13/844,196.
Office Action dated Jun. 14, 2017 in U.S. Appl. No. 14/073,029.
Notice of Allowance dated Jul. 7, 2017 in in U.S. Appl. No. 14/073,029.
Office Action dated Jul. 14, 2017 in U.S. Appl. No. 14/028,588.
Office Action dated May 25, 2017 in U.S. Appl. No. 14/594,300.
Examiner's Answer to Appeal Brief dated Oct. 27, 2016 in U.S. Appl. No. 12/903,651.
Advisory Action dated Mar. 7, 2017 in U.S. Appl. No. 13/108,045.
Office Action dated Oct. 12, 2016 in U.S. Appl. No. 13,777,066.
Office Action dated Dec. 29, 2016 in U.S. Appl. No. 13/844,196.
Notice of Allowance dated Jan. 13, 2017 in U.S. Appl. No. 14/093,707.
Supplemental Notice of Allowance dated Jan. 27, 2017 in U.S. Appl. No. 14/093,707.
Supplemental Notice of Allowance dated Feb. 10, 2017 in U.S. Appl. No. 14/093,707.
Supplemental Notice of Allowability dated Mar. 1, 2017 in U.S. Appl. No. 14/093,707.
Notice of Panel Decision from Pre-Appeal Brief Review dated Feb. 24, 2017 in U.S. Appl. No. 15/005,281.
Office Action dated Mar. 2, 2017 in U.S. Appl. No. 15/005,231.
Advisory Action dated Oct. 14, 2016 in U.S. Appl. No. 14/028,588.
Applicant Initiated Interview Summary dated Oct. 27, 2016 in U.S. Appl. No. 14/028,588.
Office Action dated Mar. 15, 2017 in U.S. Appl. No. 14/025,588.
Notice of Allowance dated Oct. 13, 2016 in U.S. Appl. No. 19/433,759.
U.S. Appl. No. 15/345,140, filed Nov. 10, 2016.
Notice of Allowance dated Dec. 16, 2015 is U.S. Appl. No. 14/922,750.
Notice of Allowance dated Feb. 28, 2017 in U.S. Appl. No. 14/922,750.
Office Action dated Apr. 10, 2017 in U.S. Appl. No. 14/594,300.
Markovsky, P. E., "Preparation and properties of ultrafine (submicron) structure titanium alloys", Materials Science and Engineering, 1995, A203, 4 pages.
Gil et al., "Formation of alpha-Widmanstatten structure: effects of grain size and cooling rate on the Widmanstatten morphologies and on the mechanical properties in Ti6Al4V alloy", Journal of Alloys and Compounds, 329, 2001, pp. 142-152.
Enayati et al., "Effects of temperature and effective strain on the flow behavior of Ti—6Al—4V", Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment, ed. Yang Man, China Machine Press, Apr. 2008, pp. 265-266.
Advisory Action dated Aug. 7, 2017 in U.S. Appl. No. 12/691,952.
Decision on Appeal dated Dec. 15. 2017 in U.S. Appl. No. 12/903,851.
Office Action dated Apr. 6, 2018 in U.S. Appl. No. 12/903,851.
Office Action dated Feb. 27, 2018 in U.S. Appl. No. 13/108,045.
Notice of Allowance dated Aug. 30, 2017 in U.S. Appl. No. 13/777,066.
Corrected Notice of Allowability dated Dec. 20, 2017 in U.S. Appl. No. 13/777,066.
Corrected Notice of Allowability dated Aug. 18, 2017 in U.S. Appl. No. 13/844,196.
Notice of Allowability dated Sep. 21, 2017 in U.S. Appl. No. 14/073,029.
Notice of Allowance dated May 10, 2017 in U.S. Appl. No. 15/005,281.
Corrected Notice of Allowability dated Aug. 9, 2017 in U.S. Appl. No. 15/005,281.
Advisory Action dated Sep. 12, 2017 in U.S. Appl. No. 14/028,588.
Notice of Panel Decision from Pre-Appeal Brief Review dated Oct. 27, 2017 in U.S. Appl. No. 14/028,588.
Notice of Allowance dated Feb. 9, 2018 in U.S. Appl. No. 14/028,588.
Office Action dated Sep. 13, 2017 in U.S. Appl. No. 14/594,300.
Advisor Action dated Jan. 26, 2018 in U.S. Appl. No. 14/594,300.
Office Action dated Feb. 28, 2018 in U.S. Appl. No. 14/594,300.
Office Action dated Oct. 31, 2017 in U.S. Appl. No. 15/653,985.
Office Action dated Mar. 16, 2018 in U.S. Appl. No. 15/653,985.

(56) References Cited

OTHER PUBLICATIONS

Office Action dated Dec. 6, 2017 in U.S. Appl. No. 14/948,941.
Office Action dated Feb. 15, 2018 in U.S. Appl. No. 14/948,941.
Office Action dated Apr. 2, 2018 in U.S. Appl. No. 14/881,633.
Concise Explanation for Third Party Preissuance submission under Rule 1.290 filed in U.S. Appl. No. 15/678,527, filed Jun. 5, 2018.
Guidelines for PWR Steam Generator Tubing Specifications and Repair, Electric Power Research Institute, Apr. 14, 1999, vol. 2, Revision 1, 74 pages. (accessed at https://www.epri.com/#/pages/product/TR-016743-V2R1/).
Materials Reliability Program: Guidelines for Thermally Treated Alloy 690 Pressure Vessel Nozzels, (MRP-241), Electric Power Research Institute, Jul. 25, 2008, 51 pages. (accessed at https://www.epri.com/#/pages/product/1015007/).
Microstructure Etching and Carbon Analysis Techniques, Electric Power Research Institute, May 1, 1990, 355 pages. (accessed at https://www.epri.com/#/pages/product/NP-6720-SD/).
Frodigh, John, "Some Factors Affecting the Appearance of the Microstructure in Alloy 690", Proceedings of the Eighth International Symposium on Environmental Degradation of Materials in Nuclear Power Systems—Water Reactors, American Nuclear Society, Inc., vol. 1, Aug. 10, 1997, 12 pages.
Kajimura et al., "Corrosion Resistance of TT Alloy 690 Manufactured by Various Melting Processes in High Temperature NaOH Solution", Proceedings of the Eighth International Symposium on Environmental Degradation of Materials in Nuclear Power Systems—Water Reactors, American Nuclear Society, Inc., vol. 1, Aug. 10, 1997, pp. 149-156.
Notice of Allowance dated Jun. 6, 2018 in U.S. Appl. No. 12/691,952.
Notice of Allowability dated Jul. 20, 2018 in U.S. Appl. No. 12/691,952.
Office Action dated Oct. 26, 2018 in U.S. Appl. No. 12/903,851.
Notice of Allowance dated Sep. 6, 2018 in U.S. Appl. No. 14/028,588.
Notice of Allowance dated Jun. 29, 2018 in U.S. Appl. No. 14/594,300.
Corrected Notice of Allowability dated Jul. 9, 2018 in U.S. Appl. No. 14/594,300.
Notice of Allowance dated Aug. 15, 2018 in U.S. Appl. No. 15/653,985.
Office Action dated Jul. 30, 2018 in U.S. Appl. No. 14/948,941.
Office Action dated Aug. 6, 2018 in U.S. Appl. No. 14/881,633.
Notice of Allowance dated Jun. 22, 2018 in U.S. Appl. No. 15/433,443.
Notice of Allowability dated Aug. 27, 2018 in U.S. Appl. No. 15/433,443.
Corrected Notice of Allowability dated Sep. 6, 2018 U.S. Appl. No. 15/433,443.
Notice of Allowability dated Oct. 11, 2018 in U.S. Appl. No. 15/433,443.
Corrected Notice of Allowability dated Oct. 18, 2018 in U.S. Appl. No. 15/433,443.
Office Action dated Aug. 28, 2018 in U.S. Appl. No. 15/678,527.
U.S. Appl. No. 16/122,174, filed Sep. 5, 2018.
U.S. Appl. No. 16/122,450, filed Sep. 5, 2018.
The Japan Society for Heat Treatment, Introduction of Heat Treatment, Japan, Minoru, Kanai, Jan. 10, 1974, p. 150.
Office Action dated Nov. 2, 2018 in U.S. Appl. No. 13/108,045.
Notification of Reopening Prosecution dated Dec. 19, 2018 in U.S. Appl. No. 14/028,588.
Office Action dated Feb. 1, 2019 in U.S. Appl. No. 14/028,588.
Applicant Initiated Interview Summary dated Jan. 30, 2019 in U.S. Appl. No. 14/948,941.
Office Action dated Feb. 15, 2019 in U.S. Appl. No. 14/948,941.
Notice of Allowance dated Apr. 1, 2019 in U.S. Appl. No. 14/881,633.
Notice of Allowance dated Dec. 13, 2018 in U.S. Appl. No. 15/678,527.
Office Action dated Jan. 10, 2019 in U.S. Appl. No. 15/659,661.
Office Action dated Jan. 25, 2019 in U.S. Appl. No. 15/348,140.
Office Action dated Mar. 8, 2019 in U.S. Appl. No. 15/816,128.
Angeliu et al, "Behavior of Grain Boundary Chemistry and Precipitates upon Thermal Treatment of Controlled Purity Alloy 690", Metallurgical Transactions A, vol. 21A, Aug. 1990, pp. 2097-2107.
Park et al., "Effect of heat treatment on fatigue crack growth rate of Inconel 690 and Inconel 600", Journal of Nuclear Materials, 231, 1996, pp. 204-212.
Louthan, M.R., "Optical Metallography", ASM Handbook, vol. 10, Materials Characterizations, 1986, pp. 299-308.
Kolachev B.A. el al., Titanium Alloys of Different Countries, Moscow, VILS, 2000, pp. 15-16.
High Strength Non-Magnetic Stainless Steel for Oil Drilling DNM series, Electric Steel Making, Daido Steel Co., Ltd., Japan, Jul. 27, 2012, vol. 83(1), pp. 75-76.
Office Action dated Jun. 27, 2019 in U.S. Appl. No. 12/903,851.
Office Action dated Jul. 12, 2019 in U.S. Appl. No. 12/903,851.
Corrected Notice of Allowability dated Aug. 14, 2019 in U.S. Appl. No. 12/903,851.
Office Action dated Jun. 27, 2019 in U.S. Appl. No. 13/108,045.
Notice of Allowance dated Jun. 26, 2019 in U.S. Appl. No. 14/028,588.
Notice of Allowance dated May 29, 2019 in U.S. Appl. No. 14/948,941.
Corrected Notice of Allowability dated Jun. 25, 2019 in U.S. Appl. No. 14/948,941.
Corrected Notice of Allowability dated May 15, 2019 in U.S. Appl. No. 14/881,633.
Office Action dated Sep. 16, 2019 in U.S. Appl. No. 16/122,450.
Notice of Allowance dated May 22, 2019 in U.S. Appl. No. 15/659,661.
Corrected Notice of Allowability dated May 29, 2019 in U.S. Appl. No. 15/659,661.
Notice of Allowance dated May 9, 2019 in U.S. Appl. No. 15/348,140.
Corrected Notice of Allowability dated Aug. 7, 2019 in U.S. Appl. No. 15/348,140.
Office Action dated Aug. 1, 2019 in U.S. Appl. No. 15/816,128.
Office Action dated Aug. 6, 2019 in U.S. Appl. No. 15/816,128.
Notice of Allowance dated Sep. 19, 2019 in U.S. Appl. No. 15/816,128.
Office Action dated Feb. 10, 2020 in U.S. Appl. No. 13/108,045.
Office Action dated Dec. 9, 2019 in U.S. Appl. No. 16/122,174.
Office Action dated Dec. 20, 2019 in U.S. Appl. No. 16/122,450.
Notice of Allowance dated Jan. 21, 2020 in U.S. Appl. No. 16/122,450.
Notice of Allowability dated Jan. 21, 2020 in U.S. Appl. No. 15/816,128.
Office Action dated May 13, 2020 in U.S. Appl. No. 15/897,219.
U.S. Appl. No. 16/779,689, filed Feb. 3, 2020.
Notice of Allowance dated Jun. 24, 2020 in U.S. Appl. No. 16/122,174.
Notice of Abandonment dated Aug. 27, 2020 in U.S. Appl. No. 15/897,219.
Notice of Abandonment dated Aug. 20, 2020 in U.S. Appl. No. 13/108,045.
Office Action dated Nov. 2, 2020 in U.S. Appl. No. 16/439,859.

* cited by examiner

METHODS FOR PROCESSING METAL ALLOYS

BACKGROUND OF THE TECHNOLOGY

Field of the Technology

The present disclosure relates to methods for thermomechanically processing metal alloys.

Description of the Background of the Technology

When a metal alloy workpiece such as, for example, an ingot, a bar, or a billet, is thermomechanically processed (i.e., hot worked), the surfaces of the workpiece cool faster than the interior of the workpiece. A specific example of this phenomenon occurs when a bar of a metal alloy is heated and then forged using a radial forging press or an open die press forge. During the hot forging, the grain structure of the metal alloy deforms due to the action of the dies. If the temperature of the metal alloy during deformation is lower than the alloy's recrystallization temperature, the alloy will not recrystallize, resulting in a grain structure composed of elongated unrecrystallized grains. If, instead, the temperature of the alloy during deformation is greater than or equal to the recrystallization temperature of the alloy, the alloy will recrystallize into an equiaxed structure.

Since metal alloy workpieces typically are heated to temperatures greater than the alloy's recrystallization temperature before hot forging, the interior portion of the workpiece, which does not cool as fast as the workpiece surfaces, usually exhibits a fully recrystallized structure on hot forging. However, the surfaces of the workpiece can exhibit a mixture of unrecrystallized grains and fully recrystallized grains due to the lower temperatures at the surfaces resulting from relatively rapid cooling. Representative of this phenomenon, FIG. 1 shows the macrostructure of a radial forged bar of Datalloy HP™ Alloy, a superaustenitic stainless steel alloy available from ATI Allvac, Monroe, N.C., USA, showing unrecrystallized grains in the bar's surface region. Unrecrystallized grains in the surface region are undesirable because, for example, they increase noise level during ultrasonic testing, reducing the usefulness of such testing. Ultrasonic inspection may be required to verify the condition of the metal alloy workpiece for use in critical applications. Secondarily, the unrecrystallized grains reduce the alloy's high cycle fatigue resistance.

Prior attempts to eliminate unrecrystallized grains in the surface region of a thermomechanically processed metal alloy workpiece, such as a forged bar, for example, have proven unsatisfactory. For example, excessive growth of grains in the interior portion of alloy workpieces has occurred during treatments to eliminate surface region unrecrystallized grains. Extra large grains also can make ultrasonic inspection of metal alloys difficult. Excessive grain growth in interior portions also can reduce fatigue strength of an alloy workpiece to unacceptable levels. In addition, attempts to eliminate unrecrystallized grains in the surface region of a thermomechanically processed alloy workpiece have resulted in the precipitation of deleterious intermetallic precipitates such as, for example, sigma-phase (σ-phase). The presence of such precipitates can decrease corrosion resistance.

It would be advantageous to develop methods for thermomechanically processing metal alloy workpieces in a way that minimizes or eliminates unrecrystallized grains in a surface region of the workpiece. It would also be advantageous to develop methods for thermomechanically processing metal alloy workpieces so as to provide an equiaxed recrystallized grain structure through the cross-section of the workpiece, and wherein the cross-section is substantially free of deleterious intermetallic precipitates, while limiting the average grain size of the equiaxed grain structure.

SUMMARY

According to one non-limiting aspect of the present disclosure, a method of processing a metal alloy comprises heating a metal alloy to a temperature in a working temperature range. The working temperature range is from the recrystallization temperature of the metal alloy to a temperature just below the incipient melting temperature of the metal alloy. The metal alloy is then worked at a temperature in the working temperature range. After working the metal alloy, a surface region of the metal alloy is heated to a temperature in a working temperature range. The surface region of the metal alloy is maintained within the working temperature range for a period of time sufficient to recrystallize the surface region of the metal alloy, and to minimize grain growth in the internal region of the metal alloy. The metal alloy is cooled from the working temperature range to a temperature and at a cooling rate that minimize grain growth in the metal alloy.

According to another aspect of the present disclosure, a non-limiting embodiment of a method of processing a superaustenitic stainless steel alloy comprises heating a superaustenitic stainless steel alloy to a temperature in an intermetallic phase dissolution temperature range. The intermetallic phase dissolution temperature range may be from the solvus temperature of the intermetallic phase to just below the incipient melting temperature of the superaustenitic stainless steel alloy. In a non-limiting embodiment, the intermetallic phase is the sigma-phase (σ-phase), comprised of Fe—Cr—Ni intermetallic compounds. The superaustenitic stainless steel alloy is maintained in the intermetallic phase dissolution temperature range for a time sufficient to dissolve the intermetallic phase and minimize grain growth in the superaustenitic stainless steel alloy. Subsequently, the superaustenitic stainless steel alloy is worked at a temperature in the working temperature range from just above the apex temperature of the time-temperature-transformation curve for the intermetallic phase of the superaustenitic stainless steel alloy, to just below the incipient melting temperature of the superaustenitic stainless steel alloy. Subsequent to working, a surface region of the superaustenitic stainless steel alloy is heated to a temperature in an annealing temperature range, wherein the annealing temperature range is from a temperature just above the apex temperature of the time-temperature-transformation curve for the intermetallic phase of the alloy to just below the incipient melting temperature of the alloy The temperature of the superaustenitic stainless steel alloy does not cool to intersect the time-temperature-transformation curve during the time period from working the alloy to heating at least a surface region of the alloy to a temperature in the annealing temperature range. The surface region of the superaustenitic stainless steel alloy is maintained in the annealing temperature range for a time sufficient to recrystallize the surface region, and minimize grain growth in the superaustenitic stainless steel alloy. The alloy is cooled to a temperature and at a cooling rate that inhibit formation of the intermetallic precipitate of the superaustenitic stainless steel alloy, and minimize grain growth.

According to another non-limiting aspect of the present disclosure, a hot worked superaustenitic stainless steel alloy comprises, in weight percent based on total alloy weight, up to 0.2 carbon, up to 20 manganese, 0.1 to 1.0 silicon, 14.0 to 28.0 chromium, 15.0 to 38.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, iron, and incidental impurities. The superaustenitic stainless steel alloy includes an equiaxed recrystallized grain structure through a cross-section of the alloy, and an average grain size in a range of ASTM 00 to ASTM 3. The equiaxed recrystallized grain structure of the hot worked superaustenitic stainless steel alloy is substantially free of an intermetallic sigma-phase precipitate.

BRIEF DESCRIPTION OF THE DRAWINGS

The features and advantages of methods, alloys, and articles described herein may be better understood by reference to the accompanying drawings in which.

Figure 1:
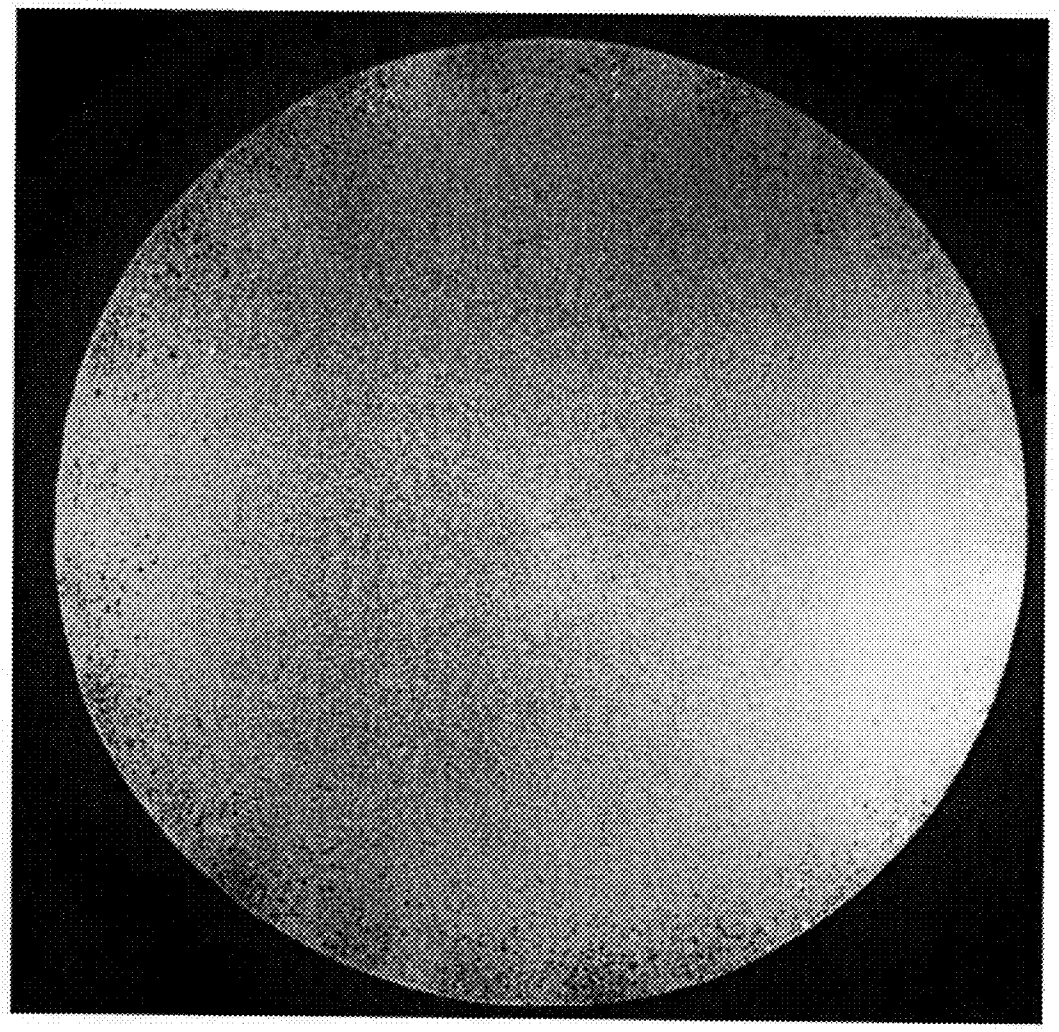
FIG. 1 Prior Art
FIG. 1 shows a macrostructure of a radial forged bar of Datalloy HP™ superaustenitic stainless steel alloy including unrecrystallized grains in a surface region of the bar.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

It is to be understood that certain descriptions of the embodiments described herein have been simplified to illustrate only those steps, elements, features, and/or aspects that are relevant to a clear understanding of the disclosed embodiments, while eliminating, for purposes of clarity, other steps, elements, features, and/or aspects. Persons having ordinary skill in the art, upon considering the present description of the disclosed embodiments, will recognize that other steps, elements, and/or features may be desirable in a particular implementation or application of the disclosed embodiments. However, because such other steps, elements, and/or features may be readily ascertained and implemented by persons having ordinary skill in the art upon considering the present description of the disclosed embodiments, and are therefore not necessary for a complete understanding of the disclosed embodiments, a description of such steps, elements, and/or features is not provided herein. As such, it is to be understood that the description set forth herein is merely exemplary and illustrative of the disclosed embodiments and is not intended to limit the scope of the invention as defined solely by the claims.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. § 112, first paragraph, and 35 U.S.C. § 132(a).

The grammatical articles "one", "a", "an", and "the", if and as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Figure 2:
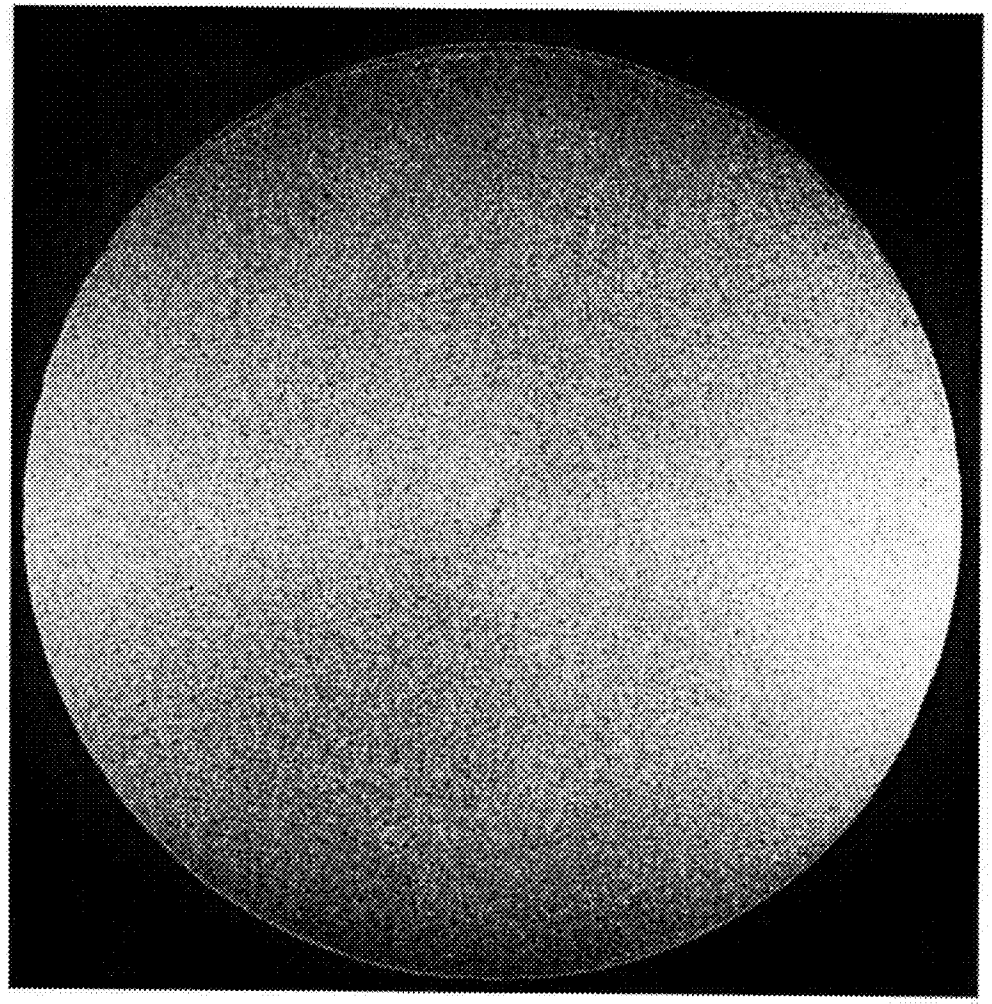
FIG. 2 Prior Art
FIG. 2 shows a macrostructure of a radial forged bar of Datalloy HP™ superaustenitic stainless steel alloy that was annealed at high temperature (2150° F.)

It is possible to eliminate unrecrystallized surface grains in a hot worked metal alloy bar or other workpiece by performing an anneal heat treatment whereby the alloy is heated to an annealing temperature exceeding the recrystallization temperature of the alloy and held at temperature until recrystallization is complete. However, superaustenitic stainless steel alloys and certain other austenitic stainless steel alloys are susceptible to the formation of a deleterious intermetallic precipitate, such as a sigma-phase precipitate, when processed in this way. Heating larger size bars and other large mill forms of these alloys to an annealing temperature, for example, can cause the deleterious intermetallic compounds to precipitate, particularly in a center region of the mill forms. Therefore, annealing times and temperatures must be selected not only to recrystallize surface region grains, but also to solution any intermetallic compounds. To ensure that intermetallic compounds are solutioned through the entire cross-section of a large bar, for example, it may be necessary to hold the bar at the elevated temperature for a significant time. Bar diameter is a factor in determining the minimum necessary holding time to adequately solution deleterious intermetallic compounds, but minimum holding times can be as long as one to four hours, or longer. In non-limiting embodiments, minimum holding times are 2 hours, greater than 2 hours, 3 hours, 4 hours, or 5 hours. While it may be possible to select a temperature and holding time that both solutions intermetallic compounds and recrystallizes surface region unrecrystallized grains, holding at the solution temperature for long periods may also allow grains to grow to unacceptably large dimensions. For example, the macrostructure of a radial forged bar of ATI Datalloy HP™ superaustenitic stainless steel alloy that was annealed at a high temperature (2150° F.) for a long period is illustrated in FIG. 2. The extra large grains evident in FIG. 2 formed during the heating made it difficult to ultrasonically inspect the bar to ensure its suitability for certain demanding commercial applications. In addition, the extra large grains reduced the fatigue strength of the metal alloy to unacceptably low levels.

ATI Datalloy HP™ alloy is generally described in, for example, U.S. patent application Ser. No. 13/331,135, which is incorporated by reference herein in its entirety. The measured chemistry of the ATI Datalloy HP™ superaustenitic stainless steel alloy bar shown in FIG. 2 was, in weight percent based on total alloy weight: 0.006 carbon; 4.38 manganese; 0.013 phosphorus; 0.0004 sulfur; 0.26 silicon; 21.80 chromium; 29.97 nickel; 5.19 molybdenum; 1.17 copper; 0.91 tungsten; 2.70 cobalt; less than 0.01 titanium; less than 0.01 niobium; 0.04 vanadium; less than 0.01 aluminum; 0.380 nitrogen; less than 0.01 zirconium; balance iron and undetected incidental impurities. In general, ATI Datalloy HP™ superaustenitic stainless steel alloy comprises, in weight percent based on total alloy weight, up to 0.2 carbon, up to 20 manganese, 0.1 to 1.0 silicon, 14.0 to 28.0 chromium, 15.0 to 38.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, iron, and incidental impurities.

Figure 3:
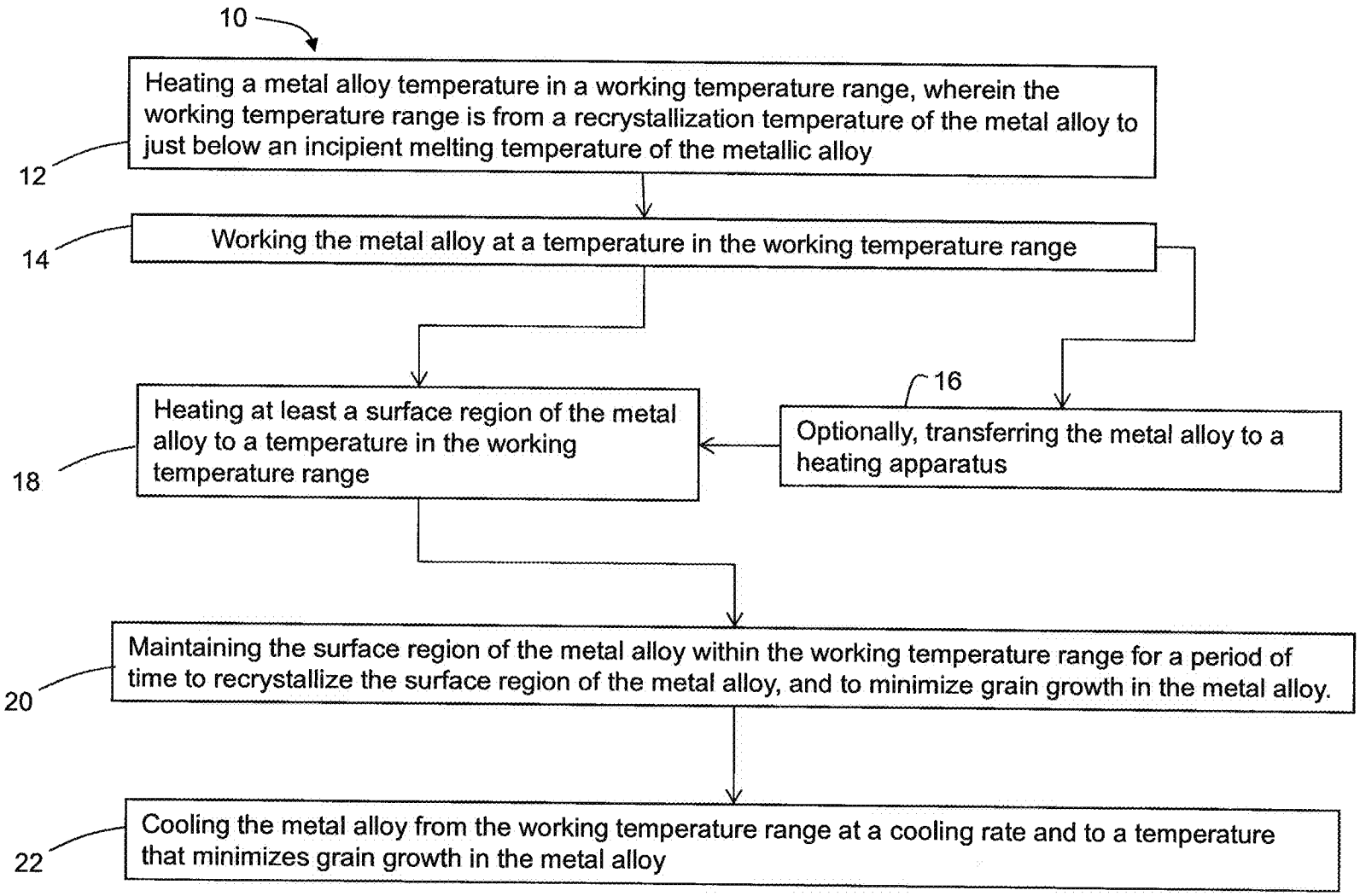
FIG. 3 is a flow chart illustrating a non-limiting embodiment of a method of processing a metal alloy according to the present disclosure.

Referring to FIG. 3, according to an aspect of this disclosure, certain steps of a non-limiting embodiment 10 of a method of processing a metal alloy are shown schematically. The method 10 may comprise heating 12 a metal alloy to a temperature in a working temperature range. The working temperature range may be from the recrystallization temperature of the metal alloy to a temperature just below an incipient melting temperature of the metal alloy. In one non-limiting embodiment of the method 10, the metal alloy is Datalloy HP™ superaustenitic stainless steel alloy and the working temperature range is from greater than 1900° F. up to 2150° F. Additionally, when the metal alloy is a superaustenitic stainless steel alloy or another austenitic stainless steel alloy, the alloy preferably is heated 12 to a temperature within the working temperature range that is sufficiently high to dissolve precipitated intermetallic phases present in the alloy.

Once heated to a temperature within the working temperature range, the metal alloy is worked 14 within the working temperature range. In a non-limiting embodiment, working the metal alloy within the working temperature range results in recrystallization of the grains of at least an internal region of the metal alloy. Because the surface region of the metal alloy tends to cool faster due to, for example, cooling from contact with the working dies, grains in the surface region of the metal alloy may cool below the working temperature range and may not recrystallize during working. In various non-limiting embodiments herein, a "surface region" of a metal alloy or metal alloy workpiece refers to a region from the surface to a depth of 0.001 inch, 0.01 inch, 0.1 inch, or 1 inch or greater into the interior of the alloy or workpiece. It will be understood that the depth of a surface region that does not recrystallize during working 14 depends on multiple factors, such as, for example, the composition of the metal alloy, the temperature of the alloy on commencement of working, the diameter or thickness of the alloy, the temperature of the working dies, and the like. The depth of a surface region that does not recrystallize during working is easily determined by a skilled practitioner without undue experimentation and, as such, the surface region that does not recrystallize during any particular non-limiting embodiment of the method of the present disclosure need not to be discussed further herein.

Because a surface region may not recrystallize during working, subsequent to working the metal alloy, and prior to any intentional cooling of the alloy, at least the surface region of the alloy is heated 18 to a temperature in the working temperature range. Optionally, after working 14 the metal alloy, the alloy is transferred 16 to a heating apparatus. In various non-limiting embodiments, the heating apparatus comprises at least one of a furnace, a flame heating station, an induction heating station, or any other suitable heating apparatus known to a person having ordinary skill in the art. It will be recognized that a heating apparatus may be in place at the working station, or dies, rolls, or any other hot working apparatus at the working station may be heated to minimize cooling of the contacted surface region of the alloy during working.

After at least the surface region of the metal alloy is heated 18 to within the working temperature range, the temperature of the surface region is maintained 20 in the working temperature range for a period of time sufficient to recrystallize the surface region of the metal alloy, so that the entire cross-section of the metal alloy is recrystallized. As applied to superaustenitic stainless steel alloys and austenitic alloys, the temperature of the superaustenitic stainless steel alloy or austenitic stainless steel alloy does not cool to intersect the time-temperature-transformation curve during the time period from working 14 the alloy to heating 18 at least a surface region of the alloy to a temperature in the annealing temperature range. This prevents deleterious intermetallic phases, such as, for example, sigma phase, from precipitating in the superaustenitic stainless steel alloy or austenitic alloy. This limitation is explained further below. In certain non-limiting embodiments of the methods according to the present disclosure applied to superaustenitic stainless steel alloys and other austenitic stainless steel alloys, the period of time during which the temperature of the heated surface region is maintained 20 within the annealing temperature range is a time sufficient to recrystallize grains in the surface region and dissolve any deleterious intermetallic precipitate phases.

After maintaining 20 the metal alloy in the working temperature range to recrystallize the surface region of the alloy, the alloy is cooled 22. In certain non-limiting embodiments, the metal alloy may be cooled to ambient temperature. In certain non-limiting embodiments, the metal alloy may be cooled from the working temperature range at a cooling rate and to a temperature sufficient to minimize grain growth in the metal alloy. In a non-limiting embodiment, a cooling rate during the cooling step is in the range of 0.3 Fahrenheit degrees per minute to 10 Fahrenheit degrees per minute. Exemplary methods of cooling according to the present disclosure include, but are not limited to, quenching (such as, for example, water quenching and oil quenching), forced air cooling, and air cooling. It will be recognized that a cooling rate that minimizes grain growth in the metal alloy will be dependent on many factors including, but not limited to, the composition of the metal alloy, the starting working temperature, and the diameter or thickness of the metal alloy. The combination of the steps of heating 18 at least a surface region of the metal alloy to the working temperature range and maintaining 20 the surface region within the working temperature range for a period of time to recrystallize the surface region may be referred to herein as "flash annealing".

As used herein in connection with the present methods, the term "metal alloy" encompasses materials that include a base or predominant metal element, one or more intentional alloying additions, and incidental impurities. As used herein, "metal alloy" includes "commercially pure" materials and other materials consisting of a metal element and incidental impurities. The present method may be applied to any suitable metal alloy. According to a non-limiting embodiment, the method according to the present disclosure may be carried out on a metal alloy selected from a superaustenitic stainless steel alloy, an austenitic stainless steel alloy, a titanium alloy, a commercially pure titanium, a nickel alloy, a nickel-base superalloy, and a cobalt alloy. In a non-limiting embodiment, the metal alloy comprises an austenitic material. In a non-limiting embodiment, the metal alloy comprises one of a superaustenitic stainless steel alloy and an austenitic stainless steel alloy. In another non-limiting embodiment, the metal alloy comprises a superaustenitic stainless steel alloy. In certain non-limiting embodiments, an alloy processed by a method of the present disclosure is selected from the following alloys: ATI Datalloy HP™ alloy (UNS unassigned); ATI Datalloy 2® ESR alloy (UNS unassigned); Alloy 25-6HN (UNS N08367); Alloy 600 (UNS N06600); Hastelloy®G-2™ alloy (UNS N06975); Alloy 625 (UNS N06625); Alloy 800 (UNS N08800); Alloy 800H (UNS N08810), Alloy 800AT (UNS N08811); Alloy 825 (UNS N08825); Alloy G3 (UNS N06985); Alloy 2535 (UNS N08535); Alloy 2550 (UNS N06255); and Alloy 316L (UNS S31603).

ATI Datalloy 2® ESR alloy is available from ATI Allvac, Monroe, N.C. USA, and is generally described in International Patent Application Publication No. WO 99/23267, which is incorporated by reference herein in its entirety. ATI Datalloy 2® ESR alloy has the following nominal chemical composition, in weight percent based on total alloy weight: 0.03 carbon; 0.30 silicon; 15.1 manganese; 15.3 chromium; 2.1 molybdenum; 2.3 nickel; 0.4 nitrogen; and balance iron and incidental impurities. In general ATI Datalloy 2® alloy comprises in percent by weight based on total alloy weight: up to 0.05 carbon; up to 1.0 silicon; 10 to 20 manganese; 13.5 to 18.0 chromium; 1.0 to 4.0 nickel; 1.5 to 3.5 molybdenum; 0.2 to 0.4 nitrogen; iron; and incidental impurities.

Superaustenitic stainless steel alloys do not fit the classic definition of stainless steel because iron constitutes less than 50 weight percent of superaustenitic stainless steel alloys. Compared with conventional austenitic stainless steels, superaustenitic stainless steel alloys exhibit superior resistance to pitting and crevice corrosion in environments containing halides.

The step of working a metal alloy at an elevated temperature according to the present method may be conducted using any of known technique. As used herein, the terms "forming", "forging", and "radial forging" refer to thermomechanical processing ("TMP"), which also may be referred to herein as "thermomechanical working" or simply as "working". As used herein, unless otherwise specified, "working" refers to "hot working". "Hot working", as used herein, refers to a controlled mechanical operation for shaping a metal alloy at temperatures at or above the recrystallization temperature of the metal alloy. Thermomechanical working encompasses a number of metal alloy forming processes combining controlled heating and deformation to obtain a synergistic effect, such as improvement in strength, without loss of toughness. See, for example, *ASM Materials Engineering Dictionary*, J. R. Davis, ed., ASM International (1992), p. 480.

In various non-limiting embodiments of the method 10 according to the present disclosure, and with reference to FIG. 3, working 14 the metal alloy comprises at least one of forging, rolling, blooming, extruding, and forming, the metal alloy. In various more specific non-limiting embodiments, working 14 the metal alloy comprises forging the metal alloy. Various non-limiting embodiments may comprise working 14 the metal alloy using at least one forging technique selected from roll forging, swaging, cogging, open-die forging, impression-die forging, press forging, automatic hot forging, radial forging, and upset forging. In a non-limiting embodiment, heated dies, heated rolls, and/or the like may be utilized to reduce cooling of a surface region of the metal alloy during working.

In certain non-limiting embodiments of methods according to the present disclosure, and again referring to FIG. 3, heating a surface region 18 of the metal alloy to a temperature within the working temperature range may comprise heating the surface region by disposing the alloy in an annealing furnace or another type of furnace. In certain non-limiting embodiments of the methods according to the present disclosure, heating a surface region 18 to the working temperature range comprises at least one of furnace heating, flame heating, and induction heating.

In certain non-limiting embodiments of methods according to the present disclosure, and again referring to FIG. 3, maintaining 20 the surface region of the metal alloy within the working temperature range may comprise maintaining the surface region within the working temperature range for a period of time sufficient to recrystallize the heated surface region of the metal alloy, and to minimize grain growth in the metal alloy. In order to avoid growth of grains in the metal alloy to excessively large size, for example, in certain non-limiting embodiments the time period during which the temperature of the surface region is maintained within the working temperature range may be limited to a time period no longer than is necessary to recrystallize the heated surface region of the metal alloy, resulting in recrystallized grains through the entire cross-section of the metal alloy. In other non-limiting embodiments, maintaining 20 comprises holding the metal alloy in the working temperature range for a period of time sufficient to permit the temperature of the metal alloy to equalize from the surface to the center of the metal alloy form. In specific non-limiting embodiments, the metal alloy is maintained 20 in the working temperature range for a period of time in a range of 1 minute to 2 hours, 5 minutes to 60 minutes, or 10 minutes to 30 minutes.

Additionally, in non-limiting embodiments of the present methods applied to superaustenitic stainless steel alloys and austenitic stainless steel alloys, the alloy preferably is worked 14, the surface region heated 18, and the alloy maintained 20 at temperatures within the working temperature range that are sufficiently high to keep intermetallic phases that are detrimental to mechanical or physical properties of the alloys in solid solution, or to dissolve any precipitated intermetallic phases into solid solution during these steps. In a non-limiting embodiment, keeping the intermetallic phases in solid solution comprises preventing the temperature of the superaustenitic stainless steel alloy and austenitic stainless steel alloy from cooling to intersect the time-temperature-transformation curve during the time period of working the alloy to heating at least a surface region of the alloy to a temperature in the annealing temperature range. This is further explained below. In certain non-limiting embodiments of methods according to the present disclosure applied to superaustenitic stainless steel alloys and austenitic stainless steel alloys, the period of time during which the temperature of the heated surface region is maintained 20 within the working temperature range is a time sufficient to recrystallize grains in the surface region, dissolve any deleterious intermetallic precipitate phases that may have precipitated during the working 14 step due to unintentional cooling of the surface region during working 14, and minimize grain growth in the alloy. It will be recognized that the length of such a time period depends on factors including the composition of the metal alloy and the dimensions (e.g., diameter or thickness) of the metal alloy form. In certain non-limiting embodiments, the surface region of the metal alloy may be maintained 20 within the working temperature range for a period of time in a range of 1 minute to 2 hours, 5 minutes to 60 minutes, or 10 minutes to 30 minutes.

In certain non-limiting embodiments of the methods according to the present disclosure wherein the metal alloy is one of a superaustenitic stainless steel alloy and an austenitic stainless steel alloy, heating 12 comprises heating to a working temperature range from the solvus temperature of the intermetallic precipitate phase to just below the incipient melting temperature of the metal alloy. In certain non-limiting embodiments of the methods according to the present disclosure wherein the metal alloy is one of a superaustenitic stainless steel alloy and an austenitic stainless steel alloy, the working temperature range during the step of working 14 the metal alloy is from a temperature just below a solvus temperature of an intermetallic sigma-phase precipitate of the metal alloy to a temperature just below the incipient melting temperature of the metal alloy.

Figure 4:
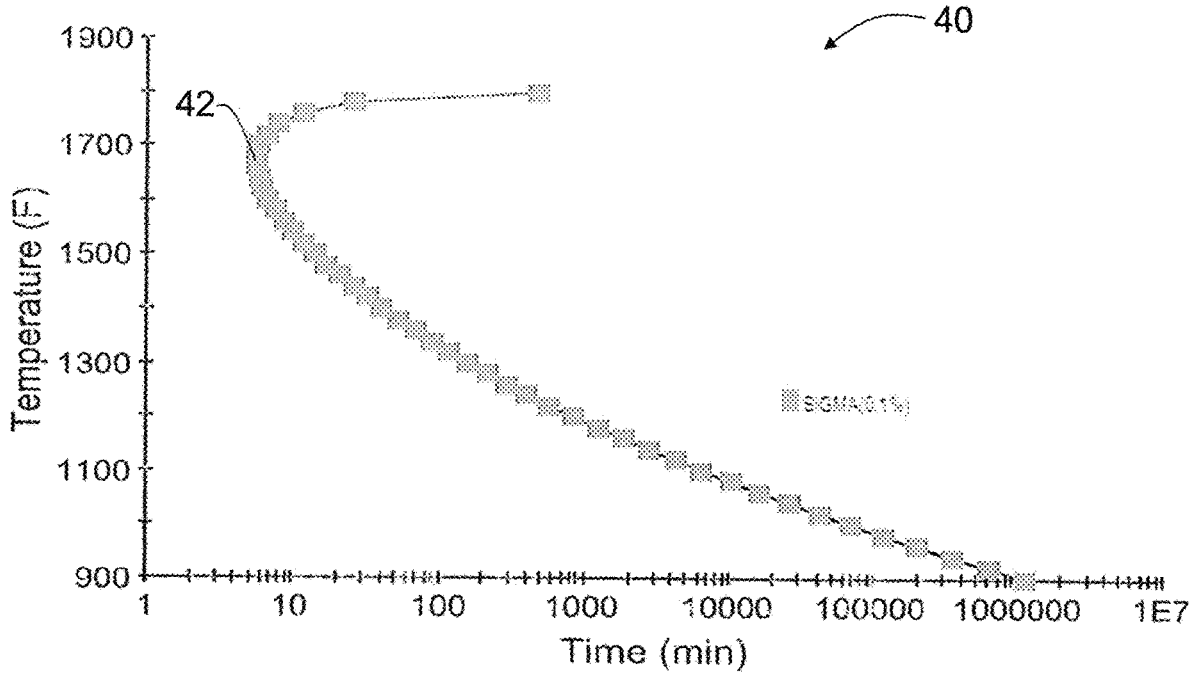
FIG. 4 is an exemplary isothermal transformation curve for a sigma-phase intermetallic precipitate in an austenitic stainless steel alloy.

Without intending to be bound to any particular theory, it is believed that the intermetallic precipitates principally form in austenitic stainless steel alloys and superaustenitic stainless steel alloys because the precipitation kinetics are sufficiently rapid to permit precipitation to occur in the alloy as the temperature of any portion of the alloy cools to a temperature at or below the temperature of the nose, or apex, of the isothermal transformation curve of the alloy for the precipitation of a particular intermetallic phase. FIG. 4 is an exemplary isothermal transformation curve 40, also known as a time-temperature-transformation diagram or curve (a "TTT diagram" or a "TTT curve"). FIG. 4 predicts the kinetics for 0.1 weight percent sigma-phase (σ-phase) intermetallic precipitation in an exemplary austenitic stainless steel alloy. It will be seen from FIG. 4 that intermetallic precipitation occurs most rapidly, i.e., in the shortest time, at the apex 42 or "nose" of the "C" curve that comprises the isothermal transformation curve 40. Accordingly, in a non-limiting embodiment of the methods according to the present disclosure, with reference to the working temperature range, the phrase "just above the apex temperature" of an intermetallic sigma-phase precipitate of the metal alloy refers to a temperature that is just above the temperature of the apex 42 of the C curve of the TTT diagram for the specific alloy. In other non-limiting embodiments, the phrase "a temperature just above the apex temperature" refers to a temperature that is in a range of 5 Fahrenheit degrees, or 10 Fahrenheit degrees, or 20 Fahrenheit degrees, or 30 Fahrenheit degrees, or 40 Fahrenheit degrees, or 50 Fahrenheit degrees above the temperature of the apex 42 of the intermetallic sigma phase precipitate of the metal alloy.

When methods according to the present disclosure are conducted on austenitic stainless steel alloys or on superaustenitic stainless steel alloys, the step of cooling 22 the metal alloy may comprise cooling at a rate sufficient to inhibit precipitation of an intermetallic sigma-phase precipitate in the metal alloy. In a non-limiting embodiment, a cooling rate is in the range of 0.3 Fahrenheit degrees per minute to 10 Fahrenheit degrees per minute. Exemplary methods of cooling according to the present disclosure include, but are not limited to, quenching, such as, for example water quenching and oil quenching, forced air cooling, and air cooling.

Specific examples of austenitic materials that may be processed using methods according to the present disclosure include, but are not limited to: ATI Datalloy HP™ alloy (UNS unassigned); ATI Datalloy 2® ESR alloy (UNS unassigned); Alloy 25-6HN (UNS N08367); Alloy 600 (UNS N06600); Hastelloy®G-2™ alloy (UNS N06975); Alloy 625 (UNS N06625); Alloy 800 (UNS N08800); Alloy 800H (UNS N08810), Alloy 800AT (UNS N08811); Alloy 825 (UNS N08825); Alloy G3 (UNS N06985); Alloy 2550 (UNS N06255); Alloy 2535 (UNS N08535); and Alloy 316L (UNS S31603).

Figure 5:
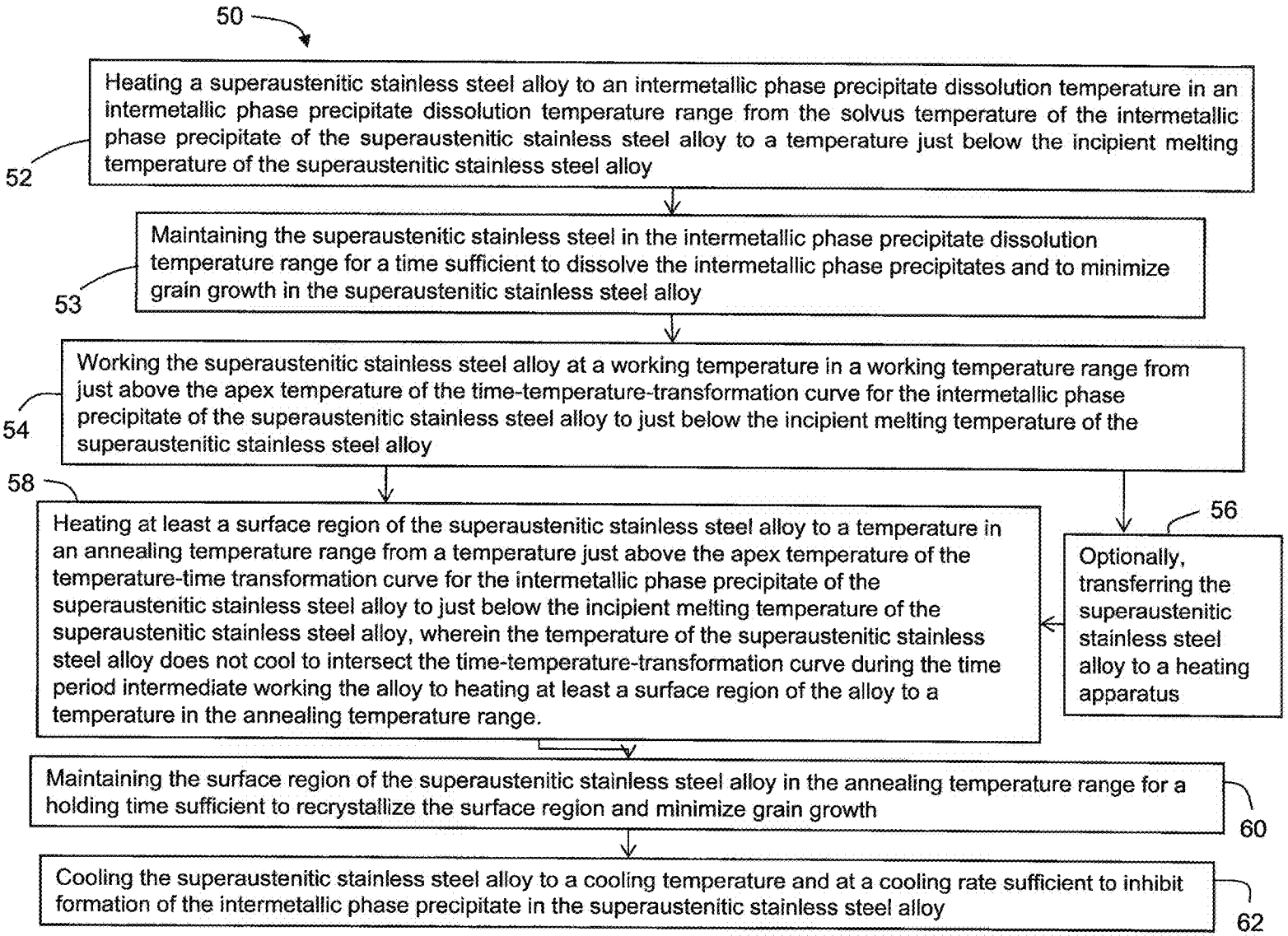
FIG. 5 is a flow chart illustrating a non-limiting embodiment of a method of processing a superaustenitic stainless steel alloy according to the present disclosure.
Figure 6:
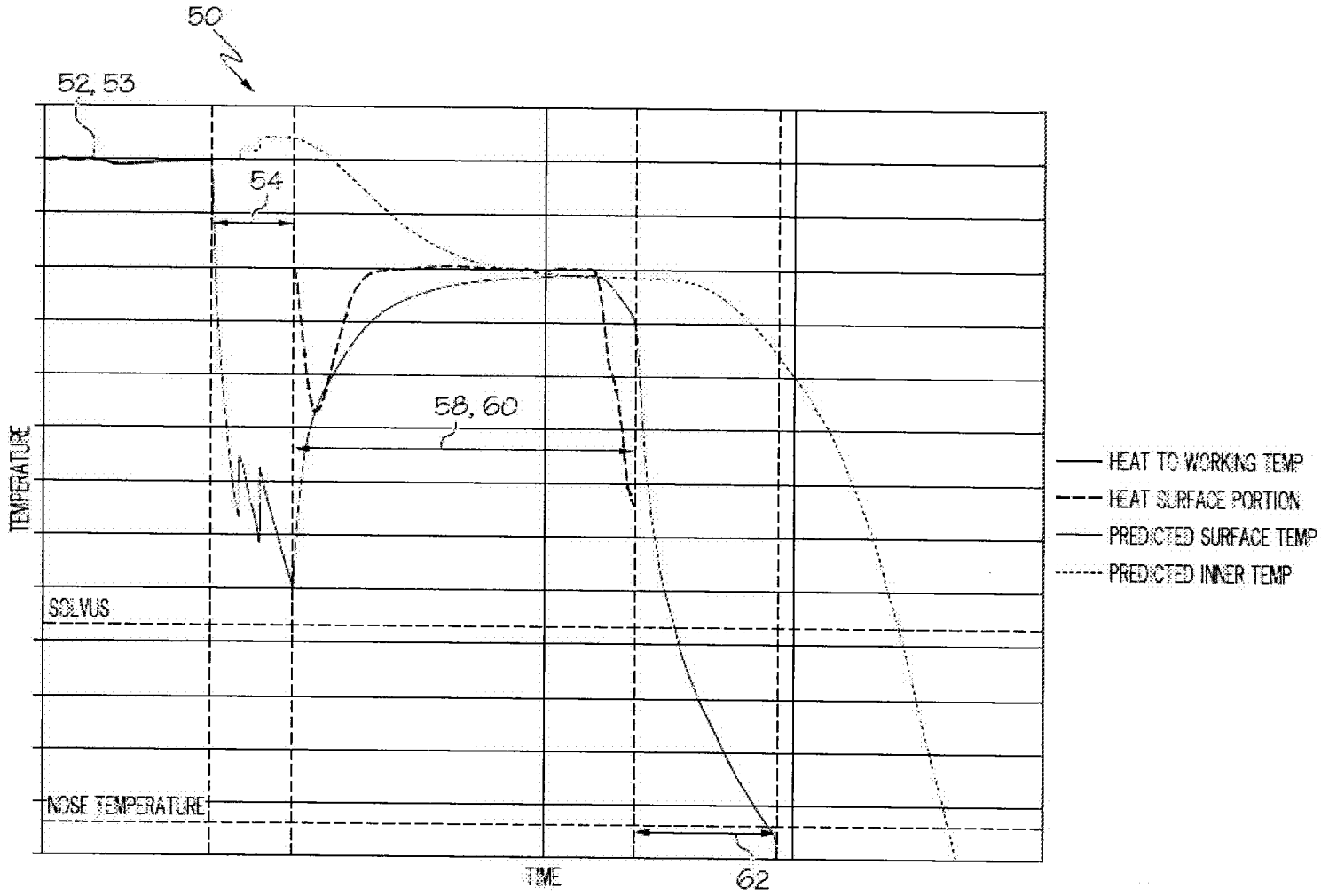
FIG. 6 is a process temperature versus time diagram according to certain non-limiting method embodiments of the present disclosure.
Figure 7:
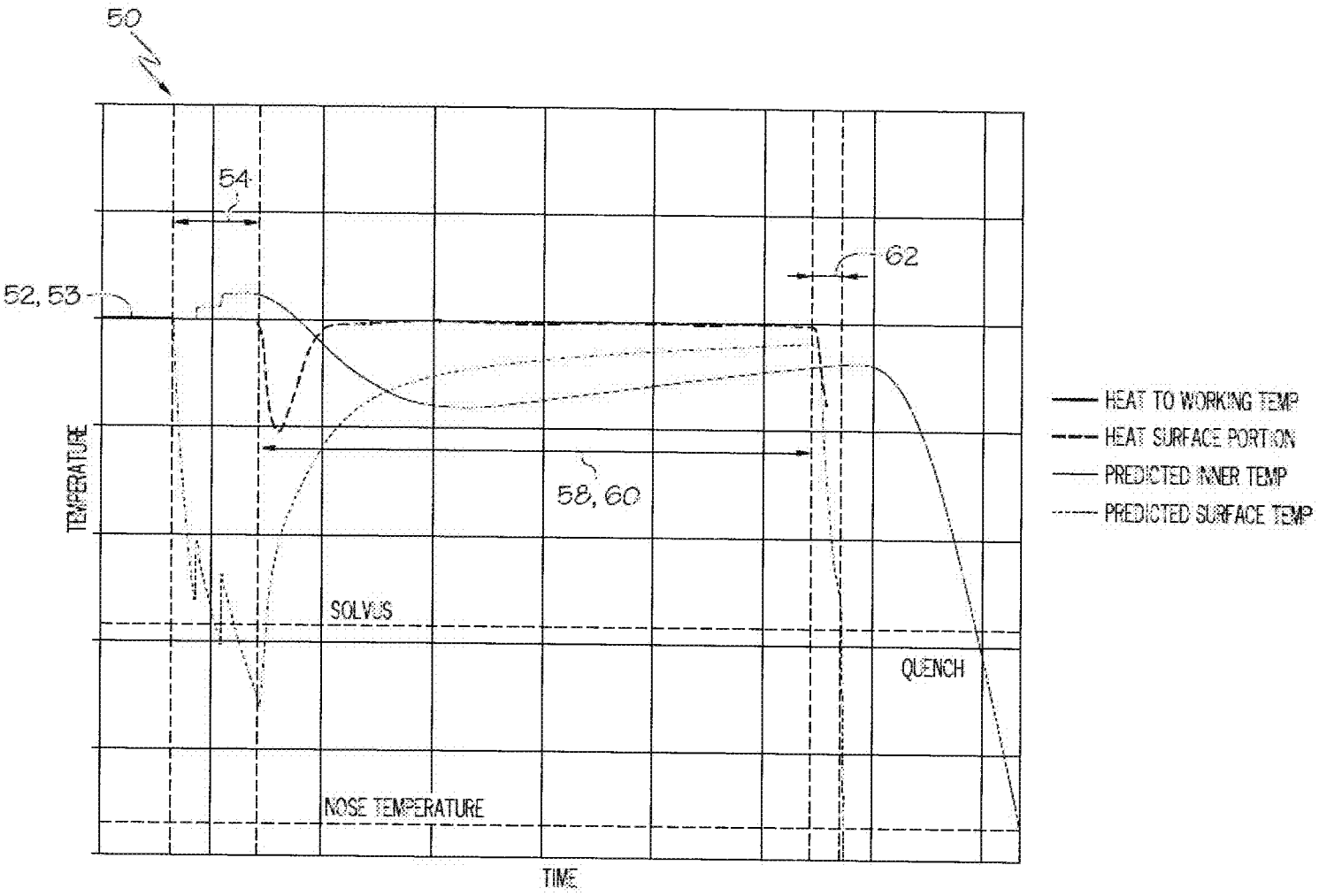
FIG. 7 is a process temperature versus time diagram according to certain non-limiting method embodiments of the present disclosure.

Referring now to FIGS. 5-7, according to an aspect of the present disclosure, a non-limiting embodiment of a method 50 of processing one of a superaustenitic stainless steel alloy and an austenitic stainless steel alloy is presented in the flow chart of FIG. 5 and the time-temperature diagrams of FIGS. 6 and 7. It should be recognized that the description below of a non-limiting embodiment of a method 50 applies equally to both superaustenitic stainless steel alloys, and austenitic stainless steel alloys, and other austenitic materials. For sake of simplicity, FIG. 5 only refers to superaustenitic stainless steels. Also, although FIGS. 6 and 7 are time-temperature plots of methods applied to Datalloy HP™ alloy, a superaustenitic stainless steel alloy, similar process steps, generally using different temperatures, are applicable to austenitic stainless steel alloys and other austenitic materials.

Method 50 comprises heating 52 a superaustenitic stainless steel alloy, for example, to a temperature in an intermetallic phase precipitate dissolution temperature range from the solvus temperature of the intermetallic phase precipitate in the superaustenitic stainless steel alloy to a temperature just below the incipient melting temperature of the superaustenitic stainless steel alloy. In a specific non-limiting method embodiment for Datalloy HP™ alloy, the intermetallic precipitate dissolution temperature range is from greater than 1900° F. to 2150° F. In a non-limiting embodiment, the intermetallic phase is the sigma-phase (σ-phase), which is comprised of Fe—Cr—Ni intermetallic compounds.

The superaustenitic stainless steel is maintained 53 in the intermetallic phase precipitate dissolution temperature range for a time sufficient to dissolve the intermetallic phase precipitates, and to minimize grain growth in the superaustenitic stainless steel alloy. In non-limiting embodiments, a superaustenitic stainless steel alloy or an austenitic stainless steel alloy may be maintained in the intermetallic phase precipitate dissolution temperature range for a period of time in a range of 1 minute to 2 hours, 5 minutes to 60 minutes, or 10 minutes to 30 minutes. It will be recognized that the minimum time required to maintain 53 a superaustenitic stainless steel alloy or austenitic stainless steel alloy in the intermetallic phase precipitate dissolution temperature range to dissolve the intermetallic phase precipitate depends on factors including, for example, the composition of the alloy, the thickness of the workpiece, and the particular temperature in the intermetallic phase precipitate dissolution temperature range that is applied. It will be understood that a person of ordinary skill, on considering the present disclosure, could determine the minimum time required for dissolution of the intermetallic phase without undue experimentation.

After the maintaining step 53, the superaustenitic stainless steel alloy is worked 54 at a temperature in a working temperature range from just above the apex temperature of the TTT curve for the intermetallic phase precipitate of the alloy to just below the incipient melting temperature of the alloy.

Because the surface region may not recrystallize during working 54, subsequent to working the superaustenitic stainless steel alloy, and prior to any intentional cooling of the alloy, at least a surface region of the superaustenitic stainless steel alloy is heated 58 to a temperature in an annealing temperature range. In a non-limiting embodiment, the annealing temperature range is from a temperature just above the apex temperature (see, for example, FIG. 4, point 42) of the time-temperature-transformation curve for the intermetallic phase precipitate of the superaustenitic stainless steel alloy to just below the incipient melting temperature of the superaustenitic stainless steel alloy.

Optionally, after working 54 the superaustenitic stainless steel alloy, the superaustenitic stainless steel alloy may be transferred 56 to a heating apparatus. In various non-limiting embodiments, the heating apparatus comprises at least one of a furnace, a flame heating station, an induction heating station, or any other suitable heating apparatus known to a person having ordinary skill in the art. For example, a heating apparatus may be in place at the working station, or the dies, rolls, or any hot working apparatus at the working station may be heated to minimize unintentional cooling of the contacted surface region of the metal alloy.

Subsequent to working 54, a surface region of the alloy is heated 58 to a temperature in an annealing temperature range. In the heating 58 step, the annealing temperature range is from a temperature just above the apex temperature (see, for example, FIG. 4, point 42) of the time-temperature-transformation curve for the intermetallic phase precipitate of the superaustenitic stainless steel alloy to just below the incipient melting temperature of the alloy. The temperature of the superaustenitic stainless steel alloy does not cool to intersect the time-temperature-transformation curve during the time period from working 54 the alloy to heating 58 at least a surface region of the alloy to a temperature in the annealing temperature range. However, it will be recognized that because the surface region of a superaustenitic stainless steel alloy cools faster than the internal region of the alloy, there is a risk that the surface region of the alloy cools below the annealing temperature range during working 54, resulting in precipitation of deleterious intermetallic phase precipitates in the surface region.

In a non-limiting embodiment, with reference to FIGS. 5-7, the surface region of the superaustenitic stainless steel alloy is maintained 60 in the annealing temperature range for a period of time sufficient to recrystallize the surface region of the superaustenitic stainless steel alloy, and dissolve any deleterious intermetallic precipitate phases that may have precipitated in the surface region, while not resulting in excessive grain growth in the alloy.

Again referring to FIGS. 5-7, subsequent to maintaining 60 the alloy in the annealing temperature range, the alloy is cooled 62 at a cooling rate and to a temperature sufficient to inhibit formation of the intermetallic sigma-phase precipitate in the superaustenitic stainless steel alloy. In a non-limiting embodiment of method 50, the temperature of the alloy on cooling 62 the alloy is a temperature that is less than the temperature of the apex of the C curve of a TTT diagram for the specific austenitic alloy. In another non-limiting embodiment, the temperature of the alloy on cooling 62 is ambient temperature.

Another aspect of the present disclosure is directed to certain metal alloy mill products. Certain metal alloy mill products according to the present disclosure comprise or consist of a metal alloy that has been processed by any of the methods according to the present disclosure, and that has not been processed to remove an unrecrystallized surface region by grinding or another mechanical material removal technique. In certain non-limiting embodiments, a metal alloy mill product according to the present disclosure comprises or consists of an austenitic stainless steel alloy or a superaustenitic stainless steel alloy that has been processed by any of the methods according to the present disclosure. In certain non-limiting embodiments, the grain structure of the metal alloy of the metal alloy mill product comprises an equiaxed recrystallized grain structure through a cross-section of the metal alloy, and an average grain size of the metal alloy is in an ASTM grain size number range of 00 to 3, or 00 to 2, or 00 to 1, as measured according to ASTM Designation E112-12. In a non-limiting embodiment, the equiaxed recrystallized grain structure of the metal alloy is substantially free of an intermetallic sigma-phase precipitate.

According to certain non-limiting embodiments, a metal alloy mill product according to the present invention comprises or consists of a superaustenitic stainless steel alloy or an austenitic stainless steel alloy having an equiaxed recrystallized grain structure throughout a cross-section of the mill product, wherein an average grain size of the alloy is in an ASTM grain size number range of 00 to 3, or 00 to 2, or 00 to 1, or 3 to 4, or an ASTM grain size number greater than 4, as measured according to ASTM Designation E112-12. In a non-limiting embodiment, the equiaxed recrystallized grain structure of the alloy is substantially free of an intermetallic sigma-phase precipitate.

Examples of metal alloys that may be included in a metal alloy mill product according to this disclosure include, but are not limited to, any of ATI Datalloy HP™ alloy (UNS unassigned); ATI Datalloy 2® ESR alloy (UNS unassigned); Alloy 25-6HN (UNS N08367); Alloy 600 (UNS N06600); ®G-2™ (UNS N06975); Alloy 625 (UNS N06625); Alloy 800 (UNS N08800); Alloy 800H (UNS N08810), Alloy 800AT (UNS N08811); Alloy 825 (UNS N08825); Alloy G3

(UNS N06985); Alloy 2535 (UNS N08535); Alloy 2550 (UNS N06255); Alloy 2535 (UNS N08535); and Alloy 316L (UNS S31603).

Concerning various aspects of this disclosure, it is anticipated that the grain size of metal alloy bars or other metal alloy mill products made according to various non-limiting embodiments of methods of the present disclosure may be adjusted by altering temperatures used in the various method steps. For example, and without limitation, the grain size of a center region of a metal alloy bar or other form may be reduced by lowering the temperature at which the metal alloy is worked in the method. A possible method for achieving grain size reduction includes heating a worked metal alloy form to a temperature sufficiently high to dissolve any deleterious intermetallic precipitates formed during prior processing steps. For example, in the case of Datalloy HP™ alloy, the alloy may be heated to a temperature of about 2100° F., which is a temperature greater than the sigma-phase solvus temperature of the alloy. The sigma-solvus temperature of superaustenitic stainless steels that may be processed as described herein typically is in the range of 1600° F. to 1800° F. The alloy may then be immediately cooled to a working temperature of, for example, about 2050° F. for Datalloy HP™ alloy, without letting the temperature fall below the temperature of the apex of the TTT diagram for the sigma-phase. The alloy may be hot worked, for example, by radial forging, to a desired diameter, followed by immediate transfer to a furnace to permit recrystallization of the unrecrystallized surface grains, without letting the time for processing between the solvus temperature and the temperature of the apex of the TTT diagram exceed the time to the TTT apex, or without letting the temperature cool below the apex of the TTT diagram for the sigma-phase during this period, or so that the temperature of the superaustenitic stainless steel alloy does not cool to intersect the time-temperature-transformation curve during the time period of working the alloy to heating at least a surface region of the alloy to a temperature in the annealing temperature range. The alloy may then be cooled from the recrystallization step to a temperature and at a cooling rate that inhibit formation of deleterious intermetallic precipitates in the alloy. A sufficiently rapid cooling rate may be achieved, for example, by water quenching the alloy.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

Example 1

Figure 8:
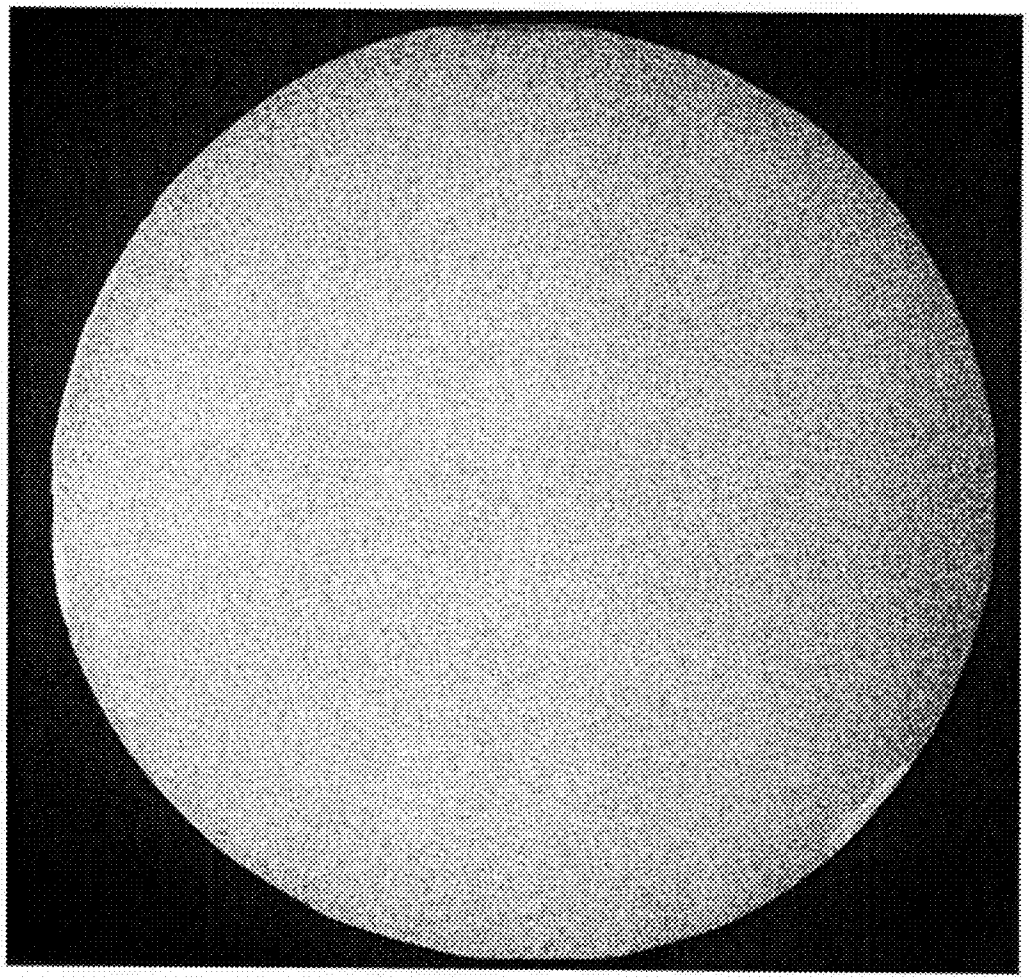
FIG. 8 shows a macrostructure of a mill product comprising Datalloy HP™ superaustenitic stainless steel alloy processed according to the process temperature versus time diagram of FIG. 6.

A 20 inch diameter ingot of Datalloy HP™ alloy, available from ATI Allvac, was prepared using a conventional melting technique combining argon oxygen decarburization and electroslag remelting steps. The ingot had the following measured chemistry, in weight percent based on total alloy weight: 0.007 carbon; 4.38 manganese; 0.015 phosphorus; less than 0.0003 sulfur; 0.272 silicon; 21.7 chromium; 30.11 nickel; 5.23 molybdenum; 1.17 copper; balance iron and unmeasured incidental impurities. The ingot was homogenized at 2200° F. and upset and drawn with multiple reheats on an open die press forge to a 12.5 inch diameter billet. The forged billet was further processed by the following steps which may be followed by reference to FIG. 6. The 12.5 inch diameter billet was heated (see, for example, FIG. 5, step 52) to an intermetallic phase precipitate dissolution temperature of 2200° F., which is a temperature in the intermetallic phase precipitate dissolution temperature range according to the present disclosure, and maintained 53 at temperature for greater than 2 hours to solutionize any sigma-phase intermetallic precipitates. The billet was cooled to 2100° F., which is a temperature in a working temperature range, according to the present disclosure, and then radial forged (54) to a 9.84 inch diameter billet. The billet was immediately transferred (56) to a furnace set at 2100° F., which is a temperature in an annealing temperature range for this alloy according to the present disclosure, and at least a surface region of the alloy was heated (58) at the annealing temperature. The billet was held in the furnace for 20 minutes so that the temperature of the surface region was maintained (60) in the annealing temperature range for a period of time sufficient to recrystallize the surface region and dissolve any deleterious intermetallic precipitate phases in the surface region, without resulting in excessive grain growth in the alloy. The billet was cooled (62) by water quenching to room temperature. The resulting macrostructure through a cross-section of the billet is shown in FIG. 8. The macrostructure shown in FIG. 8 exhibits no evidence of unrecrystallized grains at the outer perimeter region (i.e., in a surface region) of the forged bar. The ASTM grain size number of the equiaxed grain is between ASTM 0 and 1.

Example 2

Figure 9:
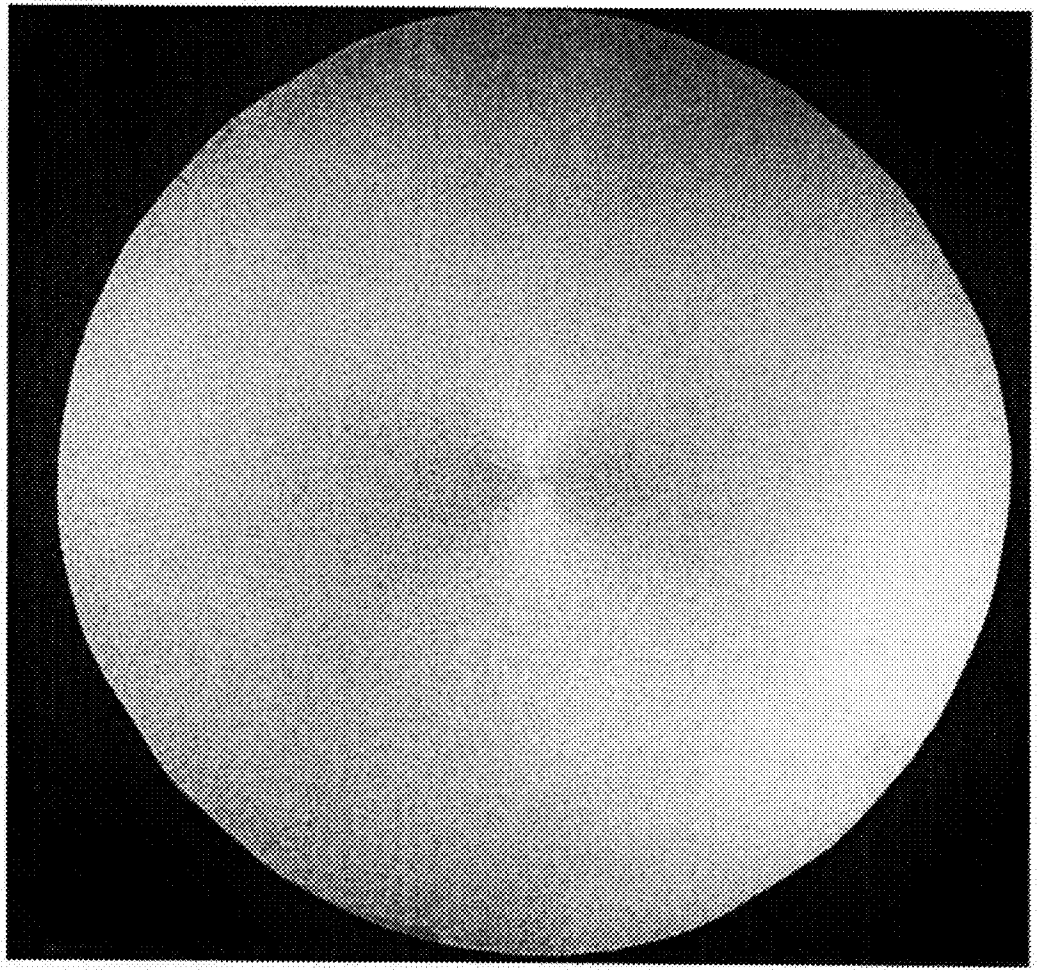
FIG. 9 shows a macrostructure of a mill product comprising Datalloy HP™ superaustenitic stainless steel alloy processed according to the process temperature versus time diagram of FIG. 7.

A 20 inch diameter ingot of Datalloy HP™ alloy, available from ATI Allvac, was prepared using a conventional melting technique combining argon oxygen decarburization and electroslag remelting steps. The ingot had the following measured chemistry, in weight percent based on total alloy weight: 0.006 carbon; 4.39 manganese; 0.015 phosphorus; 0.0004 sulfur; 0.272 silicon; 21.65 chromium; 30.01 nickel; 5.24 molybdenum; 1.17 copper; balance iron and unmeasured incidental impurities. The ingot was homogenized at 2200° F. and upset and drawn with multiple reheats on an open die press forge to a 12.5 inch diameter billet. The billet was subjected to the following process steps, which may be followed by reference to FIG. 7. The 12.5 inch diameter billet was heated (see, for example, FIG. 5, step 52) to 2100° F., which is a temperature in the intermetallic phase precipitate dissolution temperature range according to the present disclosure, and maintained (53) at temperature for greater than 2 hours to solutionize any sigma-phase intermetallic precipitates. The billet was cooled to 2050° F., which is a temperature in a working temperature range according to the present disclosure, and then radial forged (54) to a 9.84 inch diameter billet. The billet was immediately transferred (56) to a furnace set at 2050° F., which is a temperature in an annealing temperature range for this alloy according to the present disclosure, and at least a surface region of the alloy was heated (58) at the annealing temperature. The billet was held in the furnace for 45 minutes so that the temperature of the surface region was maintained (60) in the annealing temperature range for a period of time sufficient to recrystallize the surface region and dissolve any deleterious intermetallic precipitate phases in the surface region, without resulting in excessive grain growth in the alloy. The billet was cooled (62) by water quenching to room temperature. The resulting macrostructure through a cross-section of the billet is shown in FIG. 9. The macrostructure shown in FIG. 9 exhibits no evidence of unrecrystallized grains at the outer perimeter region (i.e., in a surface region) of the forged bar. The ASTM grain size number of the equiaxed grain is ASTM 3.

Example 3

A 20 inch diameter ingot of ATI Allvac AL-6XN® austenitic stainless steel alloy (UNS N08367) is prepared using a conventional melting technique combining argon oxygen decarburization and electroslag remelting steps. The ingot has the following measured chemistry, in weight percent based on total alloy weight: 0.02 carbon; 0.30 manganese; 0.020 phosphorus; 0.001 sulfur; 0.35 silicon; 21.8 chromium; 25.3 nickel; 6.7 molybdenum; 0.24 nitrogen; 0.2 copper; balance iron and other incidental impurities. The following process steps may be better understood with reference to FIG. 6. The ingot is heated (52) to 2300° F., which is a temperature in the intermetallic phase precipitate dissolution temperature range according to the present disclosure, and maintained (53) at temperature for 60 minutes to solutionize any sigma-phase intermetallic precipitates. The ingot is cooled to 2200° F., which is a temperature in a working temperature range, and then hot rolled (54) to 1 inch thick plate. The plate is immediately transferred (56) to an annealing furnace set at 2050° F. and at least a surface region of the plate is heated (58) to the annealing temperature. The annealing temperature is in an annealing temperature range from a temperature just above the apex temperature of the time-temperature-transformation curve of the intermetallic sigma-phase precipitate of the austenitic stainless steel alloy to just below than the incipient melting temperature of the austenitic stainless steel alloy. The plate does not cool to a temperature that intersects the time-temperature-transformation diagram for sigma-phase during the hot rolling (54) and transferring (56) steps. The surface region of the alloy is maintained (60) in the annealing temperature range for 15 minutes, which is sufficient to recrystallize the surface region and to dissolve any deleterious intermetallic precipitate phases, while not resulting in excessive grain growth in a surface region of the alloy. The alloy is then cooled (62) by water quenching, which provides a rate of cooling sufficient to inhibit formation of intermetallic sigma-phase precipitate in the alloy. The macrostructure exhibits no evidence of unrecrystallized grains at the surface region of the rolled plate. The ASTM grain size number of the equiaxed grain is ASTM 3.

Example 4

A 20 inch diameter ingot of Grade 316L (UNS S31603) austenitic stainless steel alloy is prepared using a conventional melting technique combining argon oxygen decarburization and electroslag remelting steps. The ingot has the following measured chemistry, in weight percent based on total alloy weight: 0.02 carbon; 17.3 chromium; 12.5 nickel; 2.5 molybdenum; 1.5 manganese; 0.5 silicon, 0.035 phosphorus; 0.01 sulfur; balance iron and other incidental impurities. The following process steps may be better understood by reference to FIG. 3. The metal alloy is heated (12) to 2190° F., which is within the alloy's working temperature range, i.e., a range from a recrystallization temperature of the alloy to just below the incipient melting temperature of the alloy. The heated ingot is worked (14). Specifically, the heated ingot is upset and drawn with multiple reheats on an open die press forge to a 12.5 inch diameter billet. The ingot is reheated to 2190° F. and radial forged (14) to a 9.84 inch diameter billet. The billet is transferred (16) to an annealing furnace set at 2048° F. The furnace temperature is in an annealing temperature range, which is a range from the recrystallization temperature of the alloy to just below the incipient melting temperature of the alloy. A surface region of the alloy is maintained (20) at the annealing temperature for 20 minutes, which is a holding time sufficient to recrystallize the surface region of the alloy. The alloy is then cooled by water quenching to ambient temperature. Water quenching provides a cooling rate sufficient to minimize grain growth in the alloy.

Example 5

A 20 inch diameter ingot of Alloy 2535 (UNS N08535), available from ATI Allvac, is prepared using a conventional melting technique combining argon oxygen decarburization and electroslag remelting steps. The ingot is homogenized at 2200° F. and upset and drawn with multiple reheats on an open die press forge to a 12.5 inch diameter billet. The 12.5 inch diameter billet is heated (see, for example, FIG. 5, step 52) to an intermetallic phase precipitate dissolution temperature of 2100° F., which is a temperature in the intermetallic phase precipitate dissolution temperature range according to the present disclosure, and maintained (53) at temperature for greater than 2 hours to solutionize any sigma-phase intermetallic precipitates. The billet is cooled to 2050° F., which is a temperature in a working temperature range according to the present disclosure, and then is radial forged (54) to a 9.84 inch diameter billet. The billet is immediately transferred (56) to a furnace set at 2050° F., which is a temperature in an annealing temperature range for the alloy according to the present disclosure. The temperature of the billet does not cool to intersect the time-temperature-transformation diagram for sigma-phase in the alloy during the time period of forging and transferring. At least a surface region of the alloy is heated (58) at the annealing temperature. The billet is held in the furnace for 45 minutes so that the temperature of the surface region is maintained (60) in the annealing temperature range for a period of time sufficient to recrystallize the surface region and dissolve any deleterious intermetallic precipitate phases in the surface region, without resulting in excessive grain growth in the alloy. The billet is cooled (62) by water quenching to room temperature. The macrostructure exhibits no evidence of unrecrystallized grains at the outer perimeter (i.e., in the surface region) of the forged bar. The ASTM grain size number of the equiaxed grain is ASTM 2.

Example 6

A 20 inch diameter ingot of Alloy 2550 (UNS N06255), available from ATI Allvac, is prepared using a conventional melting technique combining argon oxygen decarburization and electroslag remelting steps. The ingot is homogenized at 2200° F. and upset and drawn with multiple reheats on an open die press forge to a 12.5 inch diameter billet. The 12.5 inch diameter billet is heated (see, for example, FIG. 5, step 52) to an intermetallic phase precipitate dissolution temperature of 2100° F., which is a temperature in the intermetallic phase precipitate dissolution temperature range according to the present disclosure, and maintained (53) at temperature for greater than 2 hours to solutionize any sigma-phase intermetallic precipitates. The billet is cooled to 1975° F., which is a temperature in a working temperature range according to the present disclosure, and then is radial forged (54) to a 9.84 inch diameter billet. The billet is immediately transferred (56) to a furnace set at 1975° F., which is a temperature in an annealing temperature range for this alloy according to the present disclosure, and at least a surface region of the alloy is heated (58) at the annealing temperature. The temperature of the billet does not cool to intersect the time-temperature-transformation diagram for sigma-phase in he alloy during the time period of forging and transferring. The billet is held in the furnace for 75 minutes so that the temperature of the surface region is maintained (60) in the annealing temperature range for a period of time sufficient to recrystallize the surface region and dissolve any deleterious intermetallic precipitate phases in the surface region, without resulting in excessive grain growth in the alloy. The billet is cooled (62) by water quenching to room temperature. The macrostructure exhibits no evidence of unrecrystallized grains at the outer perimeter (i.e., in the surface region) of the forged bar. The ASTM grain size number of the equiaxed grain is ASTM 3.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A method of processing a superaustenitic stainless steel alloy, the method comprising:

heating a superaustenitic stainless steel alloy to a temperature in a working temperature range, wherein the working temperature range is from a recrystallization temperature of the superaustenitic stainless steel alloy to a temperature below an incipient melting temperature of the superaustenitic stainless steel alloy;

working the superaustenitic stainless steel alloy in the working temperature range to provide a superaustenitic stainless steel article comprising a surface region and a central region, wherein the surface region comprises a mixture of recrystallized grains and unrecrystallized grains, and wherein the central region is fully recrystallized;

transferring the superaustenitic stainless steel alloy article to a heating apparatus within a time that does not exceed the time to an apex of a time-temperature-transformation curve for dissolution of an intermetallic sigma-phase precipitate of the superaustenitic stainless steel alloy;

heating the surface region of the superaustenitic stainless steel alloy article to a temperature range of greater than 1900° F. to 2000° F.;

maintaining the surface region of the superaustenitic stainless steel alloy article in the temperature range of greater than 1900° F. to 2000° F. for 1 minute to 30 minutes to recrystallize only grains in the surface region of the superaustenitic stainless steel alloy article and provide a fully recrystallized surface region; and cooling the superaustenitic stainless steel alloy article from the temperature range of greater than 1900° F. to 2000° F. at a cooling rate and to a temperature that minimizes grain growth in the superaustenitic stainless steel alloy article;

wherein after the cooling the superaustenitic stainless steel alloy article, an average grain size of the superaustenitic stainless steel alloy article is in an ASTM grain size number range of 00 to less than 3 wherein the cooling rate comprises a range from 0.3 Fahrenheit degrees per minute to 10 Fahrenheit degrees per minute.

2. The method of claim 1, wherein the superaustenitic stainless steel alloy comprises, in percent by weight based on total alloy weight: up to 0.2 carbon; up to 20 manganese; 0.1 to 1.0 silicon; 14.0 to 28.0 chromium; 15.0 to 38.0 nickel; 2.0 to 9.0 molybdenum; 0.1 to 3.0 copper; 0.08 to 0.9 nitrogen; 0.1 to 5.0 tungsten; 0.5 to 5.0 cobalt; up to 1.0 titanium; up to 0.05 boron; up to 0.05 phosphorus; up to 0.05 sulfur; iron; and incidental impurities.

3. The method of claim 1, wherein the superaustenitic stainless steel alloy comprises, in percent by weight based on total alloy weight: up to 0.05 carbon; up to 1.0 silicon; 10 to 20 manganese; 13.5 to 18.0 chromium; 1.0 to 4.0 nickel; 1.5 to 3.5 molybdenum; 0.2 to 0.4 nitrogen; iron; and incidental impurities.

4. The method of claim 1, wherein the superaustenitic stainless steel alloy comprises one of a UNS N08367 alloy, a UNS N06600 alloy; a UNS N06975 alloy; a UNS N06625 alloy; a UNS N08800 alloy; a UNS N08810 alloy, a UNS N08811 alloy; a UNS N08825 alloy; a UNS N06985 alloy; a UNS N08535 alloy; a UNS N06255 alloy; and a UNS S31603 alloy.

5. The method of claim 1, wherein working the superaustenitic stainless steel alloy comprises at least one of forging, rolling, blooming, extruding, and forming the superaustenitic stainless steel alloy.

6. The method of claim 1, wherein working the superaustenitic stainless steel alloy comprises at least one of roll forging, swaging, cogging, open-die forging, impression-die forging, press forging, automatic hot forging, radial forging, and upset forging the superaustenitic stainless steel alloy.

7. The method of claim 1, wherein heating the surface region of the superaustenitic stainless steel alloy article comprises at least one of furnace heating, flame heating, and induction heating the surface region of the superaustenitic stainless steel alloy article.

8. The method of claim 1, wherein maintaining the surface region of the superaustenitic stainless steel alloy article comprises maintaining the surface region of the superaustenitic stainless steel alloy article in the temperature range of greater than 1900° F. to 2000° F. for 5 minutes to 30 minutes.

9. The method of claim 1, wherein:

heating the superaustenitic stainless steel alloy to the working temperature range comprises heating the superaustenitic stainless steel alloy to a temperature range from a solvus temperature of the intermetallic sigma-phase precipitate of the superaustenitic stainless steel alloy to below the incipient melting temperature of the superaustenitic stainless steel alloy;

the working temperature range for working the superaustenitic stainless steel alloy is from above the apex temperature of the time-temperature-transformation diagram for the intermetallic sigma-phase precipitate of the superaustenitic stainless steel alloy to below the incipient melting temperature of the superaustenitic stainless steel alloy; and the temperature of the superaustenitic stainless steel alloy does not intersect the time-temperature-transformation diagram for the intermetallic sigma-phase precipitate of the superaustenitic stainless steel alloy during the working the superaustenitic stainless steel alloy and prior to heating the surface region of the superaustenitic stainless steel alloy article.

10. The method of claim 9, wherein working the superaustenitic stainless steel alloy comprises at least one of forging, rolling, blooming, extruding, and forming the superaustenitic stainless steel alloy.

11. The method of claim 9, wherein working the superaustenitic stainless steel alloy comprises at least one of roll forging, swaging, cogging, open-die forging, impression-die forging, press forging, automatic hot forging, radial forging, and upset forging the superaustenitic stainless steel alloy.

12. The method of claim 9, wherein heating the surface region of the superaustenitic stainless steel alloy article comprises at least one of furnace heating, flame heating, and induction heating the surface region.

13. The method of claim 9, wherein maintaining the surface region of the superaustenitic stainless steel alloy article comprises maintaining the surface region of the superaustenitic stainless steel alloy article in the temperature range of greater than 1900° F. to 2000° F. for a time sufficient to fully recrystallize the surface region, solutionize the intermetallic sigma-phase precipitate of the superaustenitic stainless steel alloy in the surface region, and minimize grain growth in the superaustenitic stainless steel alloy.

14. The method of claim 9, wherein maintaining the surface region of the superaustenitic stainless steel alloy article comprises maintaining the surface region of the superaustenitic stainless steel alloy article in the temperature range of greater than 1900° F. to 2000° F. for 5 minutes to 30 minutes.

15. The method of claim 9, wherein cooling the superaustenitic stainless steel alloy article comprises cooling at a rate sufficient to inhibit precipitation of an intermetallic sigma-phase precipitate in the superaustenitic stainless steel alloy article.

16. The method of claim 9, wherein cooling the superaustenitic stainless steel alloy article comprises one of quenching, forced air cooling, and air cooling the superaustenitic stainless steel alloy.

17. The method of claim 9, wherein cooling the superaustenitic stainless steel alloy article comprises one of water quenching and oil quenching the superaustenitic stainless steel alloy article.

18. The method of claim 9, wherein the superaustenitic stainless steel alloy comprises one of a UNS N08367 alloy; a UNS N06600 alloy; a UNS N06975 alloy; a UNS N06625 alloy; a UNS N08800 alloy; a UNS N08810 alloy, a UNS N08811 alloy; a UNS N08825 alloy; a UNS N06985 alloy; a UNS N08535 alloy; a UNS N06255 alloy; and a UNS S31603 alloy.

19. The method of claim 1, wherein the surface region of the superaustenitic stainless steel alloy article extends from a surface of the superaustenitic stainless steel alloy article to a depth of 1 inch into an interior of the superaustenitic stainless steel alloy article.

20. The method of claim 1, wherein the average grain size of the superaustenitic stainless steel alloy article is in an ASTM grain size number range of 00 to 2.

21. A method of processing a superaustenitic stainless steel alloy, the method comprising:

heating a superaustenitic stainless steel alloy to an intermetallic phase precipitate dissolution temperature in an intermetallic phase precipitate dissolution temperature range, wherein the intermetallic phase precipitate dissolution temperature range is from a solvus temperature of an intermetallic phase precipitate of the superaustenitic stainless steel alloy to a temperature just below an incipient melting temperature of the superaustenitic stainless steel alloy;

maintaining the superaustenitic stainless steel alloy in the intermetallic phase precipitate dissolution temperature range for a time sufficient to dissolve the intermetallic phase precipitate and to minimize grain growth in the superaustenitic stainless steel alloy;

working the superaustenitic stainless steel alloy at a working temperature in a working temperature range from just above an apex temperature of a time-temperature-transformation curve for the intermetallic phase precipitate of the superaustenitic stainless steel alloy to just below the incipient melting temperature of the superaustenitic stainless steel alloy to provide a superaustenitic stainless steel article comprising a surface region and a central region, wherein the surface region comprises a mixture of recrystallized grains and unrecrystallized grains, and wherein the central region is fully recrystallized;

transferring the superaustenitic stainless steel alloy article to a heating apparatus without letting the superaustenitic stainless steel article cool to the apex temperature of the time-temperature-transformation curve;

heating the surface region of the superaustenitic stainless steel alloy article to a temperature in a temperature range of greater than 1900° F. to 2000° F.;

maintaining the surface region of the superaustenitic stainless steel alloy article in the temperature range of greater than 1900° F. to 2000° F. for 1 minute to 30 minutes to recrystallize only grains in the surface region and provide a fully recrystallized surface region; and cooling the superaustenitic stainless steel alloy article to a cooling temperature at a cooling rate and to a temperature that inhibits formation of the intermetallic phase precipitate and minimizes grain growth;

wherein after the cooling the superaustenitic stainless steel alloy article, an average grain size of the superaustenitic stainless steel alloy article is in an ASTM grain size number range of 00 to less than 3 wherein the cooling rate comprises a range from 0.3 Fahrenheit degrees per minute to 10 Fahrenheit degrees per minute.

22. The method of claim 21, wherein the intermetallic phase precipitate comprises sigma-phase.

23. The method of claim 22, wherein cooling the superaustenitic stainless steel alloy article comprises one of water quenching and oil quenching the superaustenitic stainless steel alloy article.

24. The method of claim 21, wherein working the superaustenitic stainless steel alloy comprises at least one of forging, rolling, blooming, extruding, and forming the superaustenitic stainless steel alloy.

25. The method of claim 21, wherein working the superaustenitic stainless steel alloy comprises at least one of roll forging, swaging, cogging, open-die forging, impression-die forging, press forging, automatic hot forging, radial forging, and upset forging the superaustenitic stainless steel alloy.

26. The method of claim 21, wherein working the superaustenitic stainless steel alloy comprises radial forging the superaustenitic stainless steel alloy.

27. The method of claim 21, wherein heating the surface region of the superaustenitic stainless steel alloy article comprises at least one of furnace heating, flame heating, and induction heating the surface region of the superaustenitic stainless steel alloy.

28. The method of claim 21, wherein cooling the superaustenitic stainless steel alloy article comprises one of quenching, forced air cooling, and air cooling the superaustenitic stainless steel alloy article.

29. The method of claim 21, wherein the superaustenitic stainless steel alloy comprises, in percent by weight based on total alloy weight: up to 0.2 carbon; up to 20 manganese; 0.1 to 1.0 silicon; 14.0 to 28.0 chromium; 15.0 to 38.0 nickel; 2.0 to 9.0 molybdenum; 0.1 to 3.0 copper; 0.08 to 0.9 nitrogen; 0.1 to 5.0 tungsten; 0.5 to 5.0 cobalt; up to 1.0 titanium; up to 0.05 boron; up to 0.05 phosphorus; up to 0.05 sulfur; iron; and incidental impurities.

30. The method of claim 21, wherein the surface region of the superaustenitic stainless steel alloy article extends from a surface of the superaustenitic stainless steel alloy article to a depth of 1 inch into an interior of the superaustenitic stainless steel alloy article.

31. The method of claim 21, wherein maintaining the surface region of the superaustenitic stainless steel alloy article comprises maintaining the surface region of the superaustenitic stainless steel alloy article in the temperature range of greater than 1900° F. to 2000° F. for 5 minutes to 30 minutes.

32. The method of claim 21, wherein the average grain size of the superaustenitic stainless steel alloy article is in an ASTM grain size number range of 00 to 2.

33. A method of processing a superaustenitic stainless steel alloy, the method comprising:

heating a superaustenitic stainless steel alloy to a temperature in a working temperature range, wherein the working temperature range is from a recrystallization temperature of the superaustenitic stainless steel alloy to a temperature below an incipient melting temperature of the superaustenitic stainless steel alloy;

working the superaustenitic stainless steel alloy in the working temperature range to provide a superaustenitic stainless steel article comprising a surface region and a central region, wherein the surface region comprises a mixture of recrystallized grains and unrecrystallized grains, and wherein the central region is fully recrystallized;

transferring the superaustenitic stainless steel alloy article to a heating apparatus within a time that does not exceed the time to an apex of a time-temperature-transformation curve for dissolution of an intermetallic sigma-phase precipitate of the superaustenitic stainless steel alloy;

heating the surface region of the superaustenitic stainless steel alloy article to a temperature in a temperature range of greater than 2000° F. to 2150° F.;

maintaining the surface region of the superaustenitic stainless steel alloy article in the temperature range of greater than 2000° F. to 2150° F. for 1 minute to 30 minutes to recrystallize only grains in the surface region and provide a fully recrystallized surface region; and cooling the superaustenitic stainless steel alloy article from the temperature range of greater than 2000° F. to 2150° F. at a cooling rate and to a temperature that minimizes grain growth in the superaustenitic stainless steel alloy article;

wherein after the cooling the superaustenitic stainless steel alloy article, an average grain size of the superaustenitic stainless steel alloy article is in an ASTM grain size number range of 00 to less than 3 wherein the cooling rate comprises a range from 0.3 Fahrenheit degrees per minute to 10 Fahrenheit degrees per minute.

34. A method of processing a superaustenitic stainless steel alloy, the method comprising:

heating a superaustenitic stainless steel alloy to an intermetallic phase precipitate dissolution temperature in an intermetallic phase precipitate dissolution temperature range, wherein the intermetallic phase precipitate dissolution temperature range is from a solvus temperature of an intermetallic phase precipitate of the superaustenitic stainless steel alloy to a temperature just below an incipient melting temperature of the superaustenitic stainless steel alloy;

maintaining the superaustenitic stainless steel alloy in the intermetallic phase precipitate dissolution temperature range for a time sufficient to dissolve the intermetallic phase precipitate and to minimize grain growth in the superaustenitic stainless steel alloy;

working the superaustenitic stainless steel alloy at a working temperature in a working temperature range from just above an apex temperature of a time-temperature-transformation curve for the intermetallic phase precipitate of the superaustenitic stainless steel alloy to just below the incipient melting temperature of the superaustenitic stainless steel alloy to provide a superaustenitic stainless steel article comprising a surface region and a central region, wherein the surface region comprises a mixture of recrystallized grains and unrecrystallized grains, and wherein the central region is fully recrystallized;

transferring the superaustenitic stainless steel alloy article to a heating apparatus without letting the superaustenitic stainless steel article cool to the apex temperature of the time-temperature-transformation curve;

heating the surface region of the superaustenitic stainless steel alloy article to a temperature in a temperature range of greater than 2000° F. to 2150° F.;

maintaining the surface region of the superaustenitic stainless steel alloy article in the temperature range of greater than 2000° F. to 2150° F. for 1 minute to 30 minutes to recrystallize only grains in the surface region and provide a fully recrystallized surface region; and cooling the superaustenitic stainless steel alloy article to a cooling temperature at a cooling rate and to a temperature that inhibits formation of the intermetallic phase precipitate and minimizes grain growth;

wherein after the cooling the superaustenitic stainless steel alloy article, an average grain size of the superaustenitic stainless steel alloy article is in an ASTM grain size number range of 00 to less than 3 wherein the cooling rate comprises a range from 0.3 Fahrenheit degrees per minute to 10 Fahrenheit degrees per minute.

* * * * *